US005394659A

United States Patent [19]

Kawaguchi et al.

[11] Patent Number: 5,394,659

[45] Date of Patent: Mar. 7, 1995

[54] OPENABLE AND CLOSEABLE ROOF CONSTRUCTION

[75] Inventors: Mamoru Kawaguchi, 3-14-1, Minamiogikubo, Suginami-ku, Tokyo; Toshimasa Hirasawa; Tatsuo Hatato, both of Chiba, all of Japan

[73] Assignees: Mamoru Kawaguchi; Maeda Corporation, Tokyo, Japan

[21] Appl. No.: 126,548

[22] Filed: Sep. 24, 1993

Related U.S. Application Data

[62] Division of Ser. No. 809,394, Dec. 18, 1991, Pat. No. 5,257,485.

[30] Foreign Application Priority Data

Feb. 22, 1991 [JP] Japan ..... 3-028928

[51] Int. Cl.[6] ..... E04B 7/16

[52] U.S. Cl. ..... 52/66; 52/6

[58] Field of Search ..... 52/6, 64, 66, 67, 65, 52/80.1, 81.1, 82, 79, 200

[56] References Cited

FOREIGN PATENT DOCUMENTS

| | | | |
|---|---|---|---|
| 3-2438 | 1/1991 | Japan | 52/66 |
| 3-8949 | 1/1991 | Japan | 52/66 |
| 3-90763 | 4/1991 | Japan | 52/66 |
| 3-202537 | 4/1991 | Japan | 52/66 |

*Primary Examiner*—Carl D. Friedman
*Assistant Examiner*—Kien T. Nguyen
*Attorney, Agent, or Firm*—Thompson, Hine & Flory

[57] ABSTRACT

The present invention relates to an openable roof having two pairs of half dome openable roofs provided on a ring shaped set roof having a flat upper surface. In the center of the set roof, an aperture is provided; this aperture being opened or closed by these two pairs of openable roofs. Furthermore, either respective pair of these two pairs of openable roofs may be selected and utilized to open and close the aperture as necessary.

15 Claims, 23 Drawing Sheets

OPENABLE AND CLOSEABLE ROOF CONSTRUCTION

This is a divisional of application Ser. No. 07/809,394, filed Dec. 18, 1991, now U.S. Pat. No. 5,257,485.

BACKGROUND OF THE INVENTION

The present invention relates to an openable roof structure for utilization in such large scale facilities as baseball stadiums, sports arenas, and the like.

In the past, large scale athletic facilities such as baseball stadiums and sports arenas were generally not equipped with a roof. However, in recent years, there has been a demand for a structure which may be utilized regardless of the weather conditions. For example, a film material formed from glass fiber coated with a resin having as its main component tetrafluoroethylene resin (i.e., Teflon resin), has been used as a roof. Facilities utilizing this structure, which expands in response to air pressure, have been utilized. Furthermore, roof structures in which it is possible to achieve all degrees of opening have been proposed in response to the need for a rigid roof.

However, in facilities of the type mentioned above, not only athletic events, but a variety of other types of events, i.e., concerts, etc., as well are held. Therefore, it is desirable to have an ability to adjust the lighting, acoustics, etc., of the internal environment in response to the type of event being held. However, neither the facilities having air film structure roofs, nor the facilities having openable roofs which have been proposed in the prior art up to now, have been able to provide this feature.

For example, the film which is used as the roof material in air film structure roofs, is thin, allowing the transmission of light. As a result, facilities provided with this kind of roof structure have the advantage of making it is possible to utilize natural illumination. However, this structure presents a disadvantage when it becomes necessary to block natural light. It is not possible to darken the interior of the facility during the afternoon hours. Accordingly, functions at which it is necessary to provide a darkened interior (concerts, for example, where lighting effects are considerably important) cannot be held in the afternoon, presenting a considerable inconvenience.

Furthermore, in the openable roof structures which have been proposed in the prior art up to now, in the case where a film material is used as the roof material, disadvantages similar to those of the air film structure roof occur. On the other hand, when opaque metal plating is used as the roof material, while it possible to darken the internal environment even during the afternoon, this type of structure does not respond to the demand for a degree of natural lighting to be present even when the roof is shut, as when a baseball game is held on a rainy afternoon. In such a situation this type of structure presents a disadvantage in that it becomes necessary to rely completely on artificial lighting.

Furthermore, in all of the above cases, the acoustic character, i.e., reverberation time, etc., within the facility is almost entirely determined by the character of the roof and the ceiling. Therefore, the acoustics cannot be appropriately adjusted in response to the type of event being held.

Given the openable roof structures of the prior art, or air film structure roofs, it is not possible to freely adjust the environment within the facility to create appropriate conditions for the type of event being held. As a result, the usage of these facilities is restricted, presenting a serious disadvantage.

Furthermore, in the movable roof structures proposed in the prior art up to now, because extremely large scale roofs are being moved, high cost expenditures are necessary in order to ensure the safety of the roof structure. The operational costs required in order to drive the machinery for moving the roof increase, while at the same time, the opening and closing action of the roof is not carried out in a timely manner. Accordingly, it has previously not been possible to obtain a superior openable roof structure economically.

SUMMARY OF THE INVENTION

It is therefore an object of the present invention to provide a structure which responds to the demand for a openable roof which may be used irrespective of weather conditions. It is a further object of the present invention to provide a roof structure in which it is possible to adjust the environmental conditions with respect to illumination, acoustics, etc., within a facility according to the type of event being held.

The present invention provides a fitting openable structure applicable for use in baseball stadiums, athletic arenas, or the like, the outline of which, as seen from above, is either almost circular, or elliptical in shape. To achieve the above objectives, the present invention is characterized in the provision of a ring-shaped fixed roof having an aperture of a shape which is almost circular, elliptical or multisided; this aperture being opened or closed by the respective utilization of two pairs of openable roofs comprised of half domes and provided at the upper portion of the set roof. The present invention is further characterized in that one pair of these two pairs of openable roofs may be selected and used to close the aforementioned aperture, making it possible to alter the environmental conditions within the facility.

The present invention provides a fitting openable structure applicable for use in baseball stadiums, athletic arenas, or the like, the outline of which as seen from above, is either almost circular or elliptical in shape. The present invention is further characterized in the provision of a ring-shaped, fixed roof having an aperture of a shape which is almost circular, elliptical or multisided, this aperture being opened or shut by the respective use of two pairs of openable roofs comprised respectively from half domes and provided in the upper portion of the set roof. The first pair of openable roof members is provided with both planer and height measurements which are larger than those of the second pair of openable roof members, making it possible for the first pair of openable roof members to cover over the second pair of openable roof members. Utilizing these two pairs of openable roof members, it is therefore possible to close the aperture in a bilayer fashion.

The present invention provides for an openable roof characterized in the provision of a fitting openable structure applicable for use in baseball stadiums, athletic arenas, or the like, the outline of which as seen from above, is either almost circular or elliptical in shape, and as seen from the side runs parallel or inclines to the parallel plane. The present invention is further characterized in the provision of a ring-shaped set roof having in its upper surface an aperture which has as its center a position not coinciding with the center of the upper surface of the set roof. This aperture is of an almost circular, elliptical or multisided shape. At the same time, in the upper portion of the aforementioned set roof, two pairs of openable roofs are provided to open and shut the aperture. These openable roofs are comprised from respective half domes and can rotate utilizing as fulcrums the peripheral tips of the edges along which the openable roofs members contact. The first pair of openable roof members is provided with both planer and height measurements which are larger than those of the second pair of openable roof members, making it possible for the first pair of openable roof members to cover over the second pair of openable roof members. Utilizing these two pairs of openable roof members, it is therefore possible to close the aperture in a bilayer fashion.

The openable roof structure of the present invention is further characterized in that one pair of the two pairs of openable roof members is comprised of a translucent roof material, while the other pair of the two pairs of openable roof members is comprised of an opaque roof material.

Furthermore, at least one of the two pairs of openable roofs in the openable roof structure of the present invention is provided with a means to regulate sound reverberation in order to adjust the acoustics within the facility.

Next, it is a further object of the present invention to propose an economically superior openable roof structure with which it is possible to substantially decrease operational costs without requiring a plurality of movement mechanisms for moving the openable roof. The present invention is characterized in the provision of a fitting openable structure applicable for use in baseball stadiums, athletic arenas, or the like, the shape of the outline of which, as seen from above, is of an almost circular, elliptical or multisided shape, and as seen from the side, runs parallel or inclines to the parallel plane. This invention is further characterized in the provision of a ring-shaped set roof in which there is provided an aperture located in the center of the upper surface and having a shape which is either almost circular, elliptical or multisided. At the same time, in the upper section of the set roof, a pair of openable roof members, comprised of half domes, has been provided to open and close the aperture. The pair of openable roof members move horizontally in opposite directions such that the openable roof members move apart, symmetrical with respect to the straight line passing through the center point of the aperture as seen from above. Following the completion of horizontally directed movement, the openable roof members rotate in mutually opposite directions about the center of their respective half domes in such a way that the peripheral tips of their edges contact.

Furthermore, the set roof is formed so that the upper surface is approximately flat, while at the same time the height direction gradually decreases from the external peripheral edge to the internal peripheral edge. Additionally, the set roof is characterized in that it is constructed of solid struts having a plurality of reinforcement rings about this circumferential direction.

In the roof structure of the present invention, the aperture may be closed not only by either one of the two pairs of openable roof members, but may also, when conditions necessitate, be closed in a bilayer fashion by utilizing both pairs of openable roof members. Additionally, as the roof material differs in each of the two pairs of openable roof members and the equipment attached to each of the openable roof members differs, the respective functions of the two pairs of openable roof members may differ as well. Accordingly, conditions such as lighting, acoustics, etc., within the facility may by varied in response to weather conditions or according to the type of event being held in the facility by means of selecting either of the openable roof members to close the aperture.

Furthermore, as seen from above, in the roof structure of the present invention, one pair of the two pairs of openable roof members comprised of half domes moves in parallel in the direction which separates the two pairs of openable roofs mutually so as to form a line of symmetry with respect to the straight line passing through the center point of the aperture. Additionally, the two pairs of openable roofs rotate about the center of the edges along which the two pairs of openable roof members touch, in mutually opposite directions so that the peripheral tips of their edges come into contact. Because the aperture is opened or shut simply by means of these two methods of movement, it is possible to carry out the action of opening or closing the openable roof members, in response to the type of event being held, within a short period of time. Moreover, sufficient circulating air and light are allowed to enter through the aperture, making it possible to attain a sufficient feeling of spaciousness within the facility.

The present invention provides for two pairs of half dome openable roofs in the upper section of a ring shaped set roof. Because either of the two pairs of openable roofs may be selected to close the aperture, and due to the provision of mutually different roof materials in the two pairs of openable roof members and the mutually different equipment installed in the openable roof members, it is possible to vary the internal environment of the facility in response to the type of event being carried out.

Furthermore, because a structure has been provided wherein the first pair of openable roof members can cover over the second pair of openable roof members, thereby making it possible to close the aperture in a bilayer fashion, in the case where the aperture has been closed in this manner, it is possible to increase the insulating effect of the roof surface. At the same time, condensation and the like on the inner surface of the roof may be prevented. Furthermore, it is possible to reduce the snow load with respect to the second, covered pair of openable roofs. Accordingly, a facility provided with the openable roof structure of the present invention is particularly suited for use in cold and snowy regions.

Additionally, an aperture having its center at a position separated from the center of the upper surface of the ring shaped set roof is provided. Because two pairs of openable roofs, comprised of half domes, have been provided at the upper surface of the set roof to rotate using as a fulcrums the peripheral tip of the edge along which the pair of openable roof members mutually come into contact, even if the area of the aperture is made large, it is possible to ensure that the space necessary when transferring the openable roof members and the planar enclosed space of the openable roof at opening is sufficient. Therefore, it is possible to restrict the construction surface to the smallest limit. In addition, when a set roof is provided horizontally with respect to the parallel plane, upon opening the aperture, it is possible for sufficient light and circulating air to enter through the opening of the aperture, thereby providing a sufficient feeling of spaciousness within the facility. Additionally, in the event where a facility is used as a baseball stadium, the further the incline running from the outfield to home base is travelled along, the greater is the gradual increase of the height from the ground, making it possible to widen the space where the infield stands are set, thereby satisfying the demand by spectators for the ability to view a game from a closer position.

The present invention utilizes a translucent roof material in one of the openable roof members while, at the same time, an opaque material is used as the roof material in the other pair of openable roof members. As a result, it is possible to freely select the degree of natural illumination directed within the facility.

Furthermore, because a means for adjusting acoustics is installed in at least one pair of the two pairs of openable roof members, it is possible to regulate the acoustic character within the facility according to whichever of the two pairs of openable roof members is selected.

Additionally, an aperture is constructed in the center section of the upper surface of a ring shaped set roof. In the upper surface of the set roof, as seen from above, one pair of the two pairs of openable roof members, comprised of half domes, moves in parallel in the direction which separates the two pairs of openable roof members mutually so as to form a line of symmetry with respect to the straight line passing through the center point of the aperture. Additionally, the two pairs of openable roofs rotate about the center of the edges, along which the two mutually touch, in opposite directions so that the peripheral tips of each of the respective edges along which the two pairs of openable roofs touch when shut come into contact. By the simple means of these two methods of movement, the aperture may be opened or closed, and it is possible to carry out the action of opening or closing the roof within a short period of time in response to the type of event being held, without requiring a plurality of moving devices, as compared to the openable roof structures in the prior art. At the same time, it is possible for sufficient circulating air and light to enter through the aperture, making it possible to attain a sufficient feeling of spaciousness within the facility. Accordingly, the operational costs required in order to move the openable roofs may be substantially reduced, thereby economically providing an superior openable roof structure. Furthermore, even if the aperture is made sufficiently large, because it is possible to ensure that the space necessary when moving the openable roof and the enclosed planar space when opening the roof is adequate, and because it is possible to enclose the openable roof in a planer fashion within set roof 5, it is possible to restrict the construction surface of the facility to the smallest limit.

Finally, because the set roof is provided with a height measurement which decreases from the external peripheral edge to the internal peripheral edge, and is at the same time constructed of solid struts having a plurality of reinforcement rings along the circumferential direction, the set roof itself possesses sufficient strength. As a result, a simplification in structure as compared to openable roofs of the prior art is possible, while at the same time, due to the provision of a nearly flat upper surface for the set roof, it is possible to ensure the safety of the openable roof structure provided in this upper section. Furthermore, the movement of the openable roofs may be carried out easily.

DETAILED DESCRIPTION OF THE PREFERRED EMBODIMENTS

With reference to the accompanying drawings, preferred embodiments of the present invention will be described hereinafter.

Figure 1:
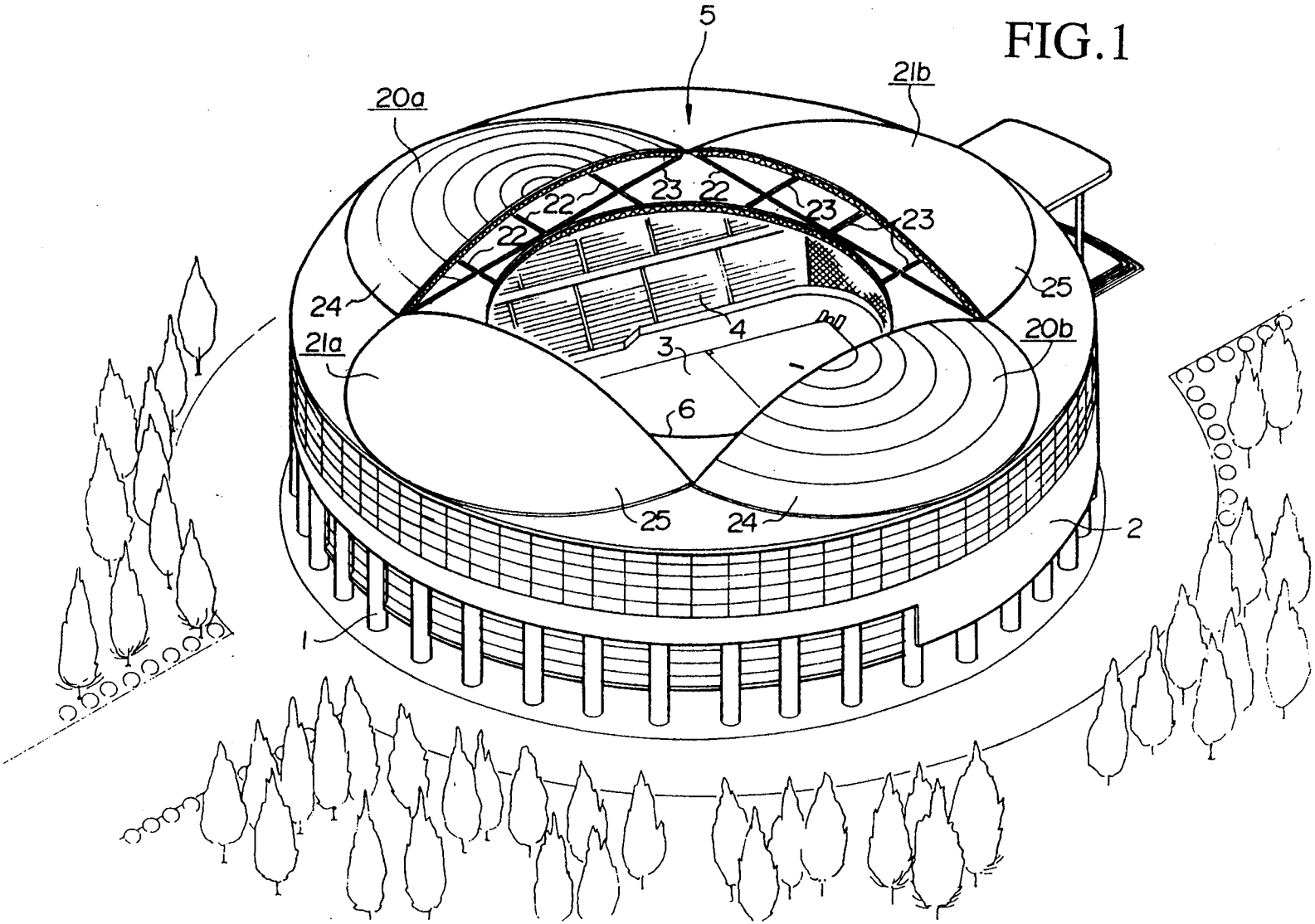
FIG. 1 is a perspective view showing the external structure of the first embodiment of the present invention.
Figure 2:
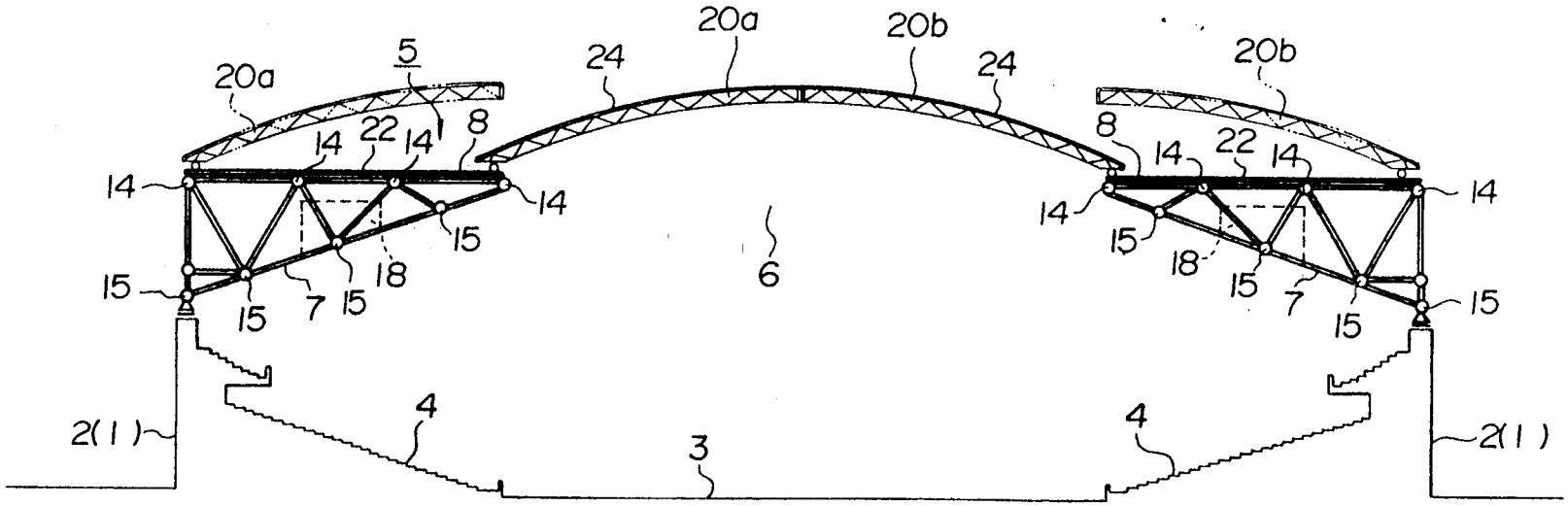
FIG. 2 is a vertical cross section of the same facility.
Figure 5:
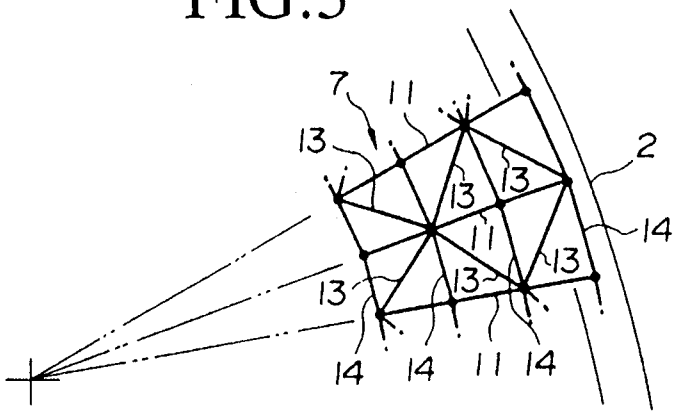
FIG. 5 is a plan view showing the upper surface of the same solid truss.
Figure 6:
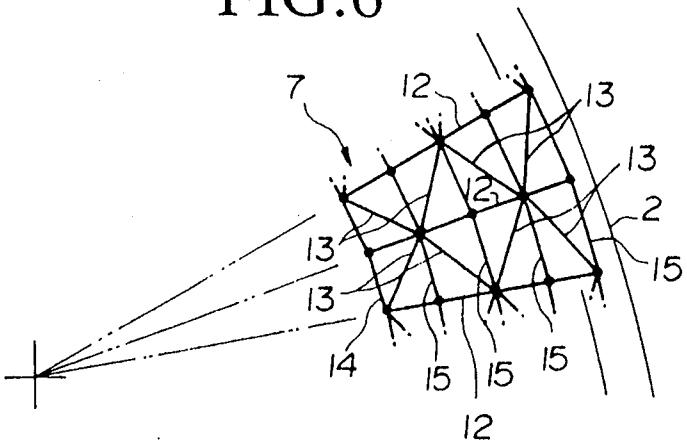
FIG. 6 is a plan view showing the lower surface of the same solid truss.
Figure 3:
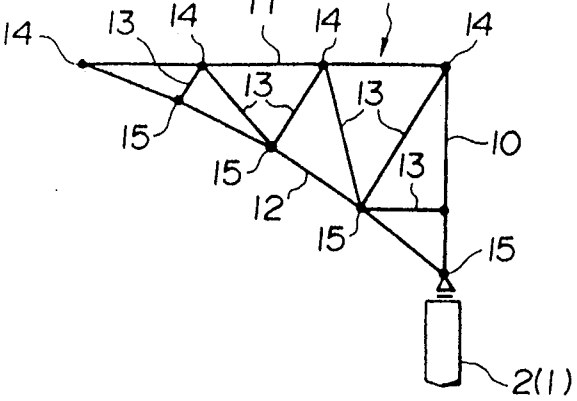
FIG. 3 is a vertical cross section showing the solid truss of the set roof in the same facility.
Figure 4:
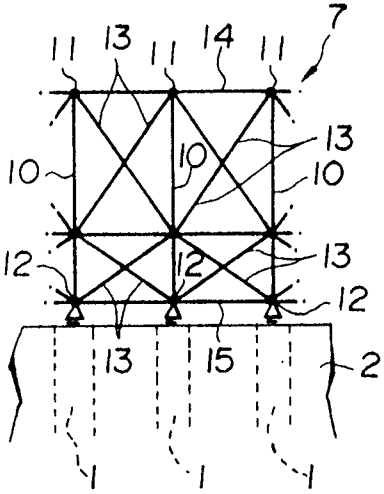
FIG. 4 is a side view seen from the external wall of the same solid truss.

First, with reference to FIGS. 1 through 13, the first embodiment of the present invention will be explained. FIG. 1 shows an external view of a baseball stadium which has been equipped with a roof having the structure of the first embodiment therein. FIG. 2 shows a cross sectional view of the same stadium. In these figures, the numeral 1 indicates a column installed at set intervals to form a circular shape as the body of the stadium. The numeral 2 indicates an external wall on the other side of which the ground (arena) is provided. At the same time, stand 4, where the spectators assemble, is provided within the circumference of ground 3.

Furthermore, the numeral 5 indicates a ring shaped set roof which is provided in such a way that it transverses nearly the entire circumference of the area above stand 4, and which is provided with an round shaped aperture 6 positioned above ground 3. This set roof 5 is provided so that the edge of the peripheral side is supported by the aforementioned column 1, and by the provision of, in the upper face of installed solid truss 7, an opaque roof material 8 such as metal plating, concrete slab, or the like.

The aforementioned solid truss 7, shown schematically in FIG. 2 and in FIGS. 3 through 6, is comprised of columns 10 which are respectively formed from steel (steel pipe, etc.), top chord 11, bottom chord 12, and lattice 13. The bottom edge of column 10 is roller borne by the top edge of column 1 and, as a result, cantilever support is provided by column 1.

Additionally, on the upper face of solid truss 7, a minimal incline is ensured and an almost parallel planar cross section is formed. At the same time, the height of solid truss 7 gradually decreases from the edge of the external periphery to the edge of the internal periphery. A plurality of reinforcement rings 14 and 15 are provided respectively along the circumferential direction of solid truss 7 in the upper and lower surface of solid truss 7. Of these reinforcement rings 14 and 15, reinforcement ring 14, which is positioned on the upper surface, bears the principle portion of the compression force, while reinforcement ring 15, which is positioned on the lower surface, bears the principle portion of the traction force. Solid truss 7 is able to direct a heavy load along the circumferential direction effectively as a result of the efficacy of reinforcement rings 14 and 15. Furthermore, because the height measurement decreases from the external peripheral edge to the internal peripheral edge, the upper surface becomes a plane, it in itself providing sufficient structural strength. As has been done before with this kind of general solid truss, a camber is attached upwardly. In other words, in the present invention, there is no need for a camber, no need for a dome form, and of course no need to introduce prestress.

Furthermore, in solid truss 7, because the lower tip of column 10 is roller supported by the head of column 1, the temperature stress of the entire suspension is effectively absorbed.

Additionally, in solid truss 7, it is possible to install any number of various types of devices (for example, illumination devices, loud speakers, devices related to fire prevention, ducts for use in heating and cooling, diffusers, inlet ports, etc.) as necessary. Furthermore, as is shown in FIG. 2, audience seat 18 may be installed in a position overlooking the arena.

Through the utilization of the two pairs of openable roofs 20*a* and 20*b*, and 21*a* and 21*b*, which have been provided in the upper section of set roof 5, aperture 6, installed in the center of set roof 5 explained above, may be opened or closed.

Figure 7:
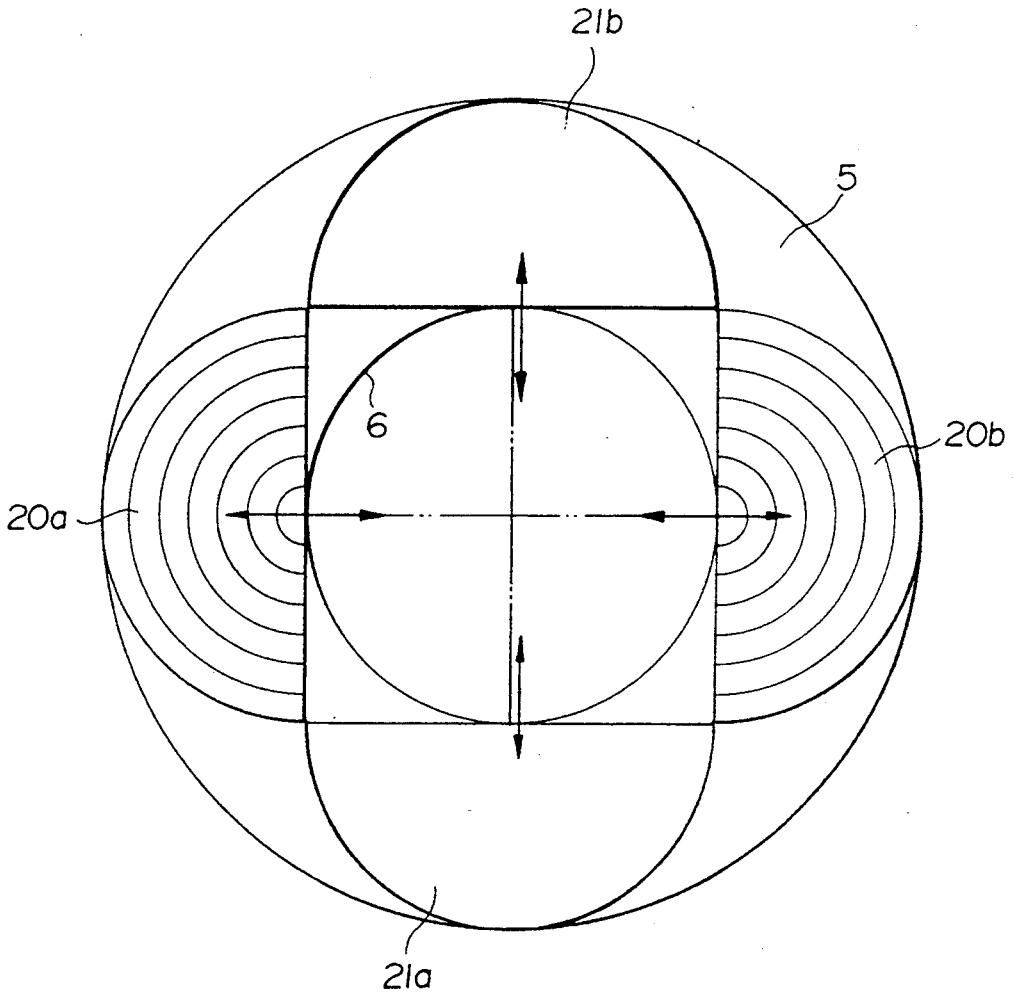
FIG. 7 is a plan view showing in outline the roof surface of the same facility.

Each of openable roofs 20*a* and 20*b* and 21*a* and 21*b* is comprised respectively from half domes through the use of solid trusses. The two pairs of openable roofs 20*a* and 20*b* and 21*a* and 21*b* are respectively supported by rails 22 and 23 (see FIG. 8) which are provided in the upper surface of set roof 5. Through use of an electric or hydraulic drive device, not shown here, the two pairs of openable roofs 20*a* and 20*b* and 21*a* and 21*b* can be moved on rails 22 and 23 along the diameter direction of set roof 5, as is shown in FIG. 7. During normal use, openable roofs 20*a* and 20*b* and 21*a* and 21*b* are ordinarily positioned on the upper portion of set roof 5, as is shown in FIGS. 1 and 7. During such times, aperture 6 would be open. However, as necessary, one pair of the two pairs of openable roofs 20*a* and 20*b* and 21*a* and 21*b* may be utilized to close aperture 6 (FIG. 2 shows the closure of aperture 6 by utilization of openable roof members 20*a* and 20*b*).

Furthermore, roof material 24 in one pair 20*a* and 20*b* of the two pairs of openable roof members 20*a* and 20*b* and 21*a* and 21*b*, utilizes an opaque material such as metal plating, concrete slab, or the like, similar to the material utilized in set roof 5. However, the other pair of openable roofs 21*a* and 21*b* utilizes, for example, a film material formed from glass fiber coated with a resin having as its main component tetrafluoroethylene resin, or some other translucent material.

Figure 8:
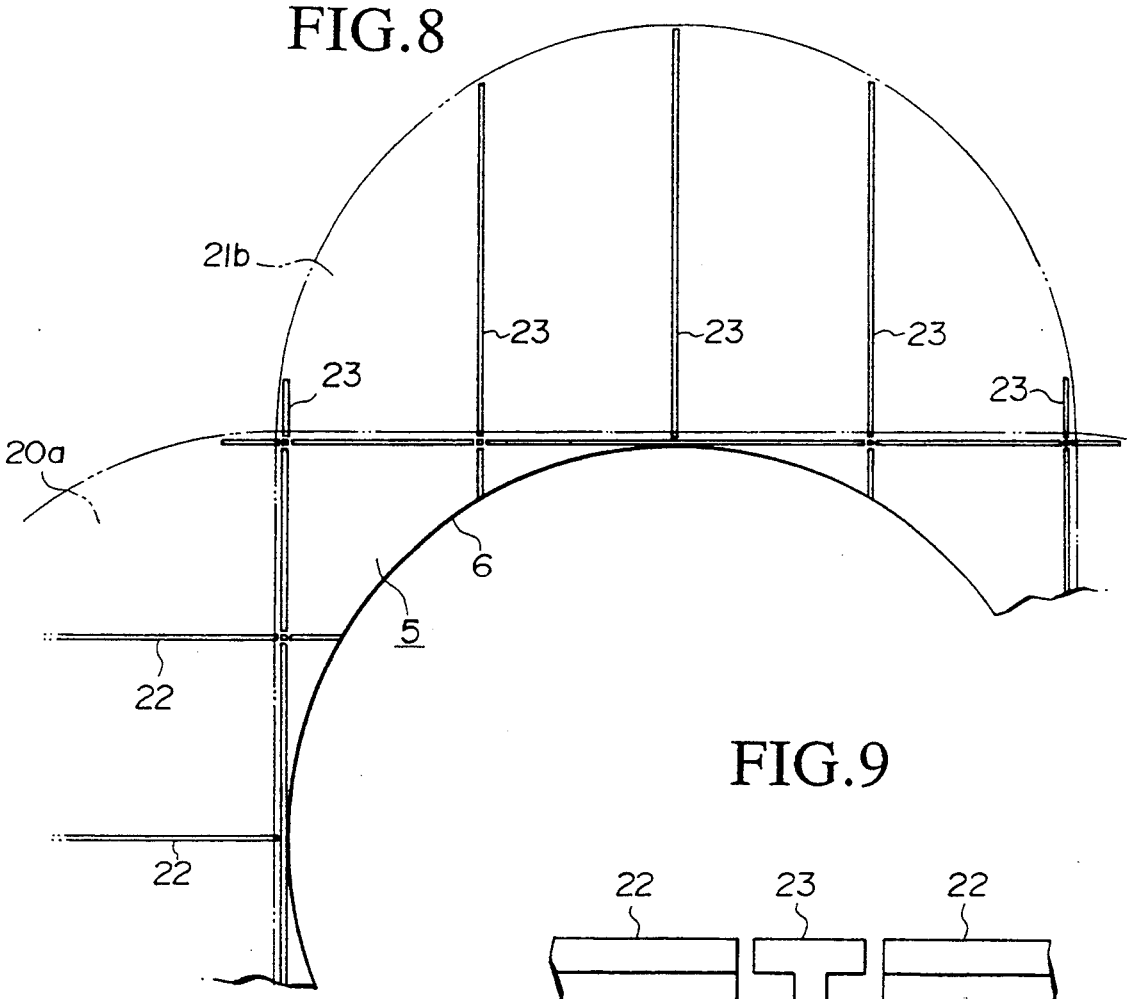
FIG. 8 is a partial enlarged view of the circumference of the aperture in the same roof surface.
Figure 9:
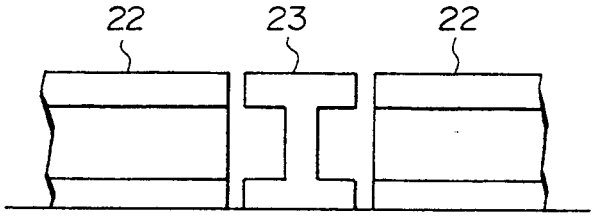
FIG. 9 is an enlarged sectional view of the rail intersection portion in the same roof structure.
Figure 10:
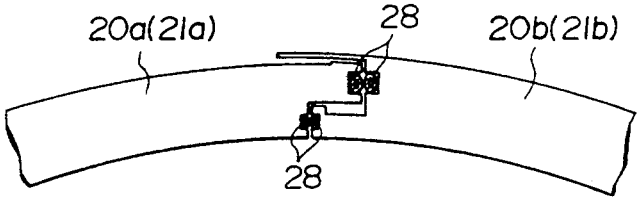
FIG. 10 is an enlarged view showing the abutting section of the openable roofs.
Figure 11:
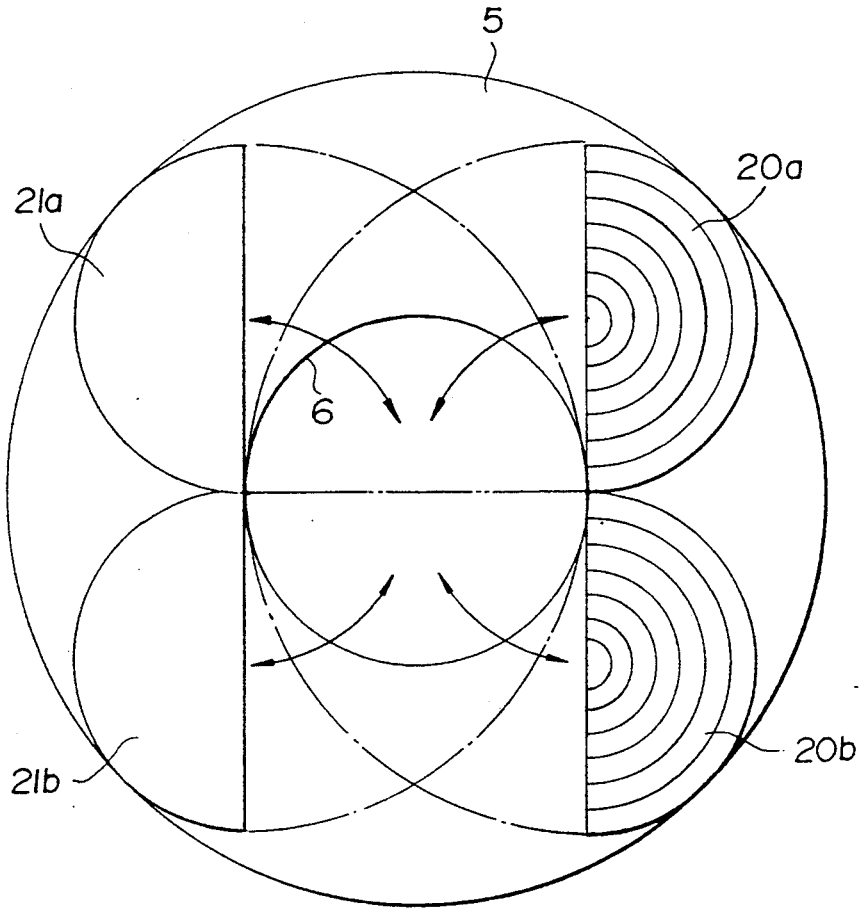
FIG. 11 is a plan view showing an example of a variation in the structure of the first embodiment.
Figure 12:
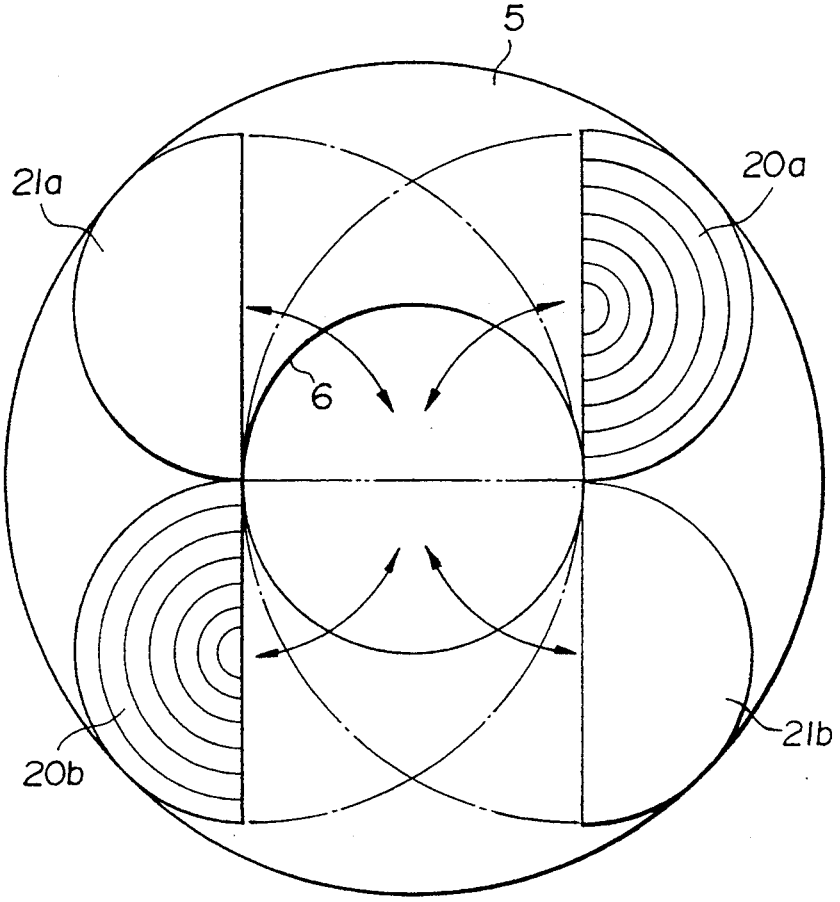
FIG. 12 is a plan view showing a further example of a variation in structure.

Additionally, although rails 22 and 23 are installed so as to intersect each other, as is shown in FIGS. 8 and 9, they have been provided so as to intersect without producing a difference in grade or interfering with the displacement of openable roofs 20*a* and 20*b* and 21*a* and 21*b*. Furthermore, when aperture 6 is closed by means of the pairs of openable roof members 20*a* and 20*b* and 21*a* and 21*b*, as is shown in FIG. 10, the edges of openable roofs 20*a* and 20*b* and 21*a* and 21*b* mutually interlock, abutting by means of the interposition of packing 28 comprised of elastic material such as rubber, and as a result, forming an air tight and water tight surface. Additionally, as was the case for set roof 5, it is also possible to install the variety of equipment types described above in openable roof members 20*a* and 20*b* and 21*a* and 21*b* as desirable.

On fine days, in a facility provided with the above roof structure, it is possible to hold a ball game or the like outdoors by opening aperture 6. At the same time, on foul weather days or as other necessities demand, because aperture 6 may be shut by means of one or both pairs of the two pairs of openable roofs 20*a* and 20*b* and 21*a* and 21*b*, the ability to utilize the facility irrespective of weather conditions is guaranteed. Additionally, the illumination within the facility may be altered in response to the type of event being held by selecting one or more of the two pairs of openable roofs 20*a* and 20*b* and 21*a* and 21*b* to close aperture 6.

In other words, in the event that a concert, or the like, is held during the afternoon hours, if aperture 6 is closed by openable roof members 20*a* and 20*b* which utilize opaque roof material 24, natural illumination is blocked, making it possible to darken the internal environment of the facility. Accordingly, it is possible to produce sufficient lighting effects. Furthermore, in the case where an athletic competition, etc., is held during foul weather, if aperture 6 is closed by openable roof 21*a* and 21*b* which utilizes translucent roof material 25, the facility can be well illuminated naturally. Accordingly, only a minimum amount of artificial illumination need be utilized to achieve sufficient lighting.

In a facility equipped with a roof of the above type of structure, it is possible to choose whether or not to utilize natural illumination in response to the type of event being held. As a result, the usage of the facility is not restricted, making it possible to freely carry out any kind of event. Additionally, in order to further improve lighting and performance effects, it is possible to freely open and shut aperture 6 by means of openable roof members 20*a* and 20*b* and 21*a* and 21*b* as an event progresses.

Furthermore, in this structure, set roof 5 is comprised from solid truss 7 having reinforcement rings 14 and 15. In addition, the upper surface of set roof 5 is formed as an almost horizontal flat surface. As compared to the openable roofs of the prior art, structure has been considerably simplified, while at the same time the structural safety of openable roof members 20*a* and 20*b* and 21*a* and 21*b* installed in the upper portion of set roof 5 is assured, and the moving of the roofs can be easily carried out.

Furthermore, because openable roofs 20 and 20*b* and 21*a* and 21*b* are comprised of the solid trusses of the half domes, their structural strength is sufficiently assured, and it is possible to sufficiently ensure a high level of effects with the facility.

Additionally, in this structure, it is possible to appropriately establish the area of aperture 6. For example, as is shown in FIG. 2, because the area of aperture 6 is approximately that of the surface of ground 3, it is possible to completely uncover the entire area above ground 3. In other words, it is possible to obtain a comparative ratio of 100% between the surface area of aperture 6 and the surface area of the ground (ratio of area uncovered), thereby adequately securing a spacious open area.

For example, in the above embodiment, through the provision of mutually differing roof materials 24 and 25 in the two pairs of openable roofs 20*a* and 20*b* and 21*a* and 21*b*, a decision may be made as to whether to naturally illuminate the facility or to block the transmission of natural light. However, in addition to or in place of controlling the lighting, it is also possible to vary the acoustic character within the facility. Sound absorbing boards or sound reflecting boards may be provided in one pair only of either of the two pairs of openable roofs 20*a* and 20*b* and 21*a* and 21*b*, or both pairs of openable roofs 20*a* and 20*b* and 21*a* and 21*b* may be provided with mutually differing means for acoustic adjustment. In response to the type of event held, one pair of openable roofs may then be selected and used to shut aperture 6.

Additionally, if the number and type of the above various equipment devices installed in openable roofs 20*a* and 20*b* and 21*a* and 21*b* differs as well, it becomes further possible to regulate a variety of environmental conditions within the facility.

Furthermore, in the above embodiment, aperture 6 is shut by means of moving the two pairs of openable roofs 20*a* and 20*b* and 21*a* and 21*b* respectively along the diameter of set roof 5, in the direction in which the two pairs of openable roofs are mutually orthogonal. However, as shown in either FIG. 11 or FIG. 12, peripheral portions of each of openable roofs 20*a* and 20*b* and 21*a* and 21*b* is coupled to set roof 5 so as to be rotatable, and by means of the respective 90° rotation of these peripheral sections, it is possible to shut aperture 6.

Figure 13:
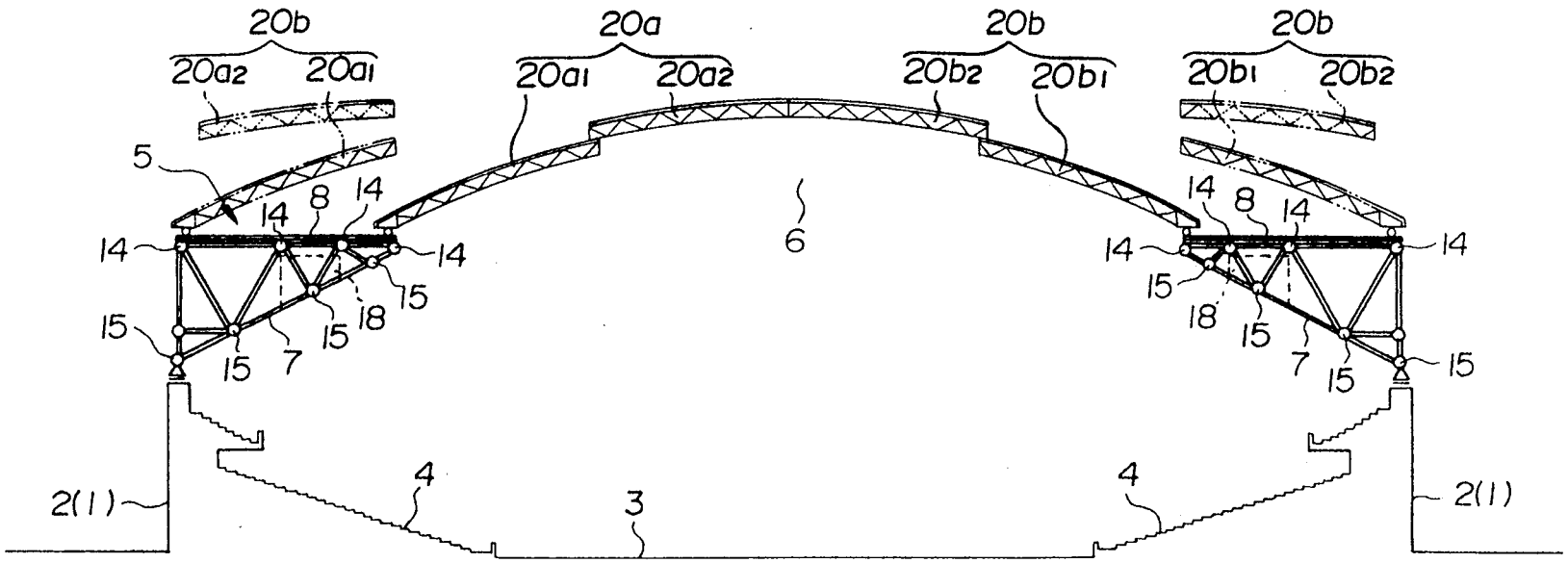
FIG. 13 is a vertical cross section showing a further example of a variation in the structure.

Furthermore, by means of this structure, the ratio of the area uncovered may be made greater than 100%. In other words, the area of aperture 6 is larger than that of the area of ground 3. Since not only the area above ground 3, but also the area above stands 4 is opened, it becomes possible to obtain a highly spacious open space. In this case, because, in comparison to the situation given in the above embodiment, the size of the openable roofs becomes larger while at the same time the set roof becomes smaller, in order to set the openable roofs on the set roof, each of the respective openable roofs may be divided. In other words, as shown in FIG. 13, openable roof members 20*a* and 20*b* may be respectively divided into 20*a*1 and 20*a*2 and 20*b*1 and 20*b*2 and placed on set roof 5 so as to be openable. Aperture 6 may also be opened by means of the vertical stacking of the roof members. In this case, in the same way as in the above embodiment, it is possible to assure the structural safety of each of the stacked openable roof members, while at the same time easily carrying out the moving of the roof members.

Moreover, the external shape of set roof 5 is not limited to a circular form, but may also be of an elliptical shape. The shape of aperture 6 provided in the center of set roof 5 is not limited to a circular form, but may also be of a multisided shape. In this case, the shape of the openable roof as seen from above is not limited to a circular shape only, but may be formed in any shape variation appropriate to the shape of aperture 6.

Additionally, although in the above embodiment the upper surface of set roof 5 is provided to be almost parallel, if necessary, it is also possible to incline the entire body of set roof 5. For example, when utilized as a baseball stadium, set roof 5 may be inclined for example 5°~10° from home base to the outfield in order to increase the level of effect within the facility.

Figure 14:
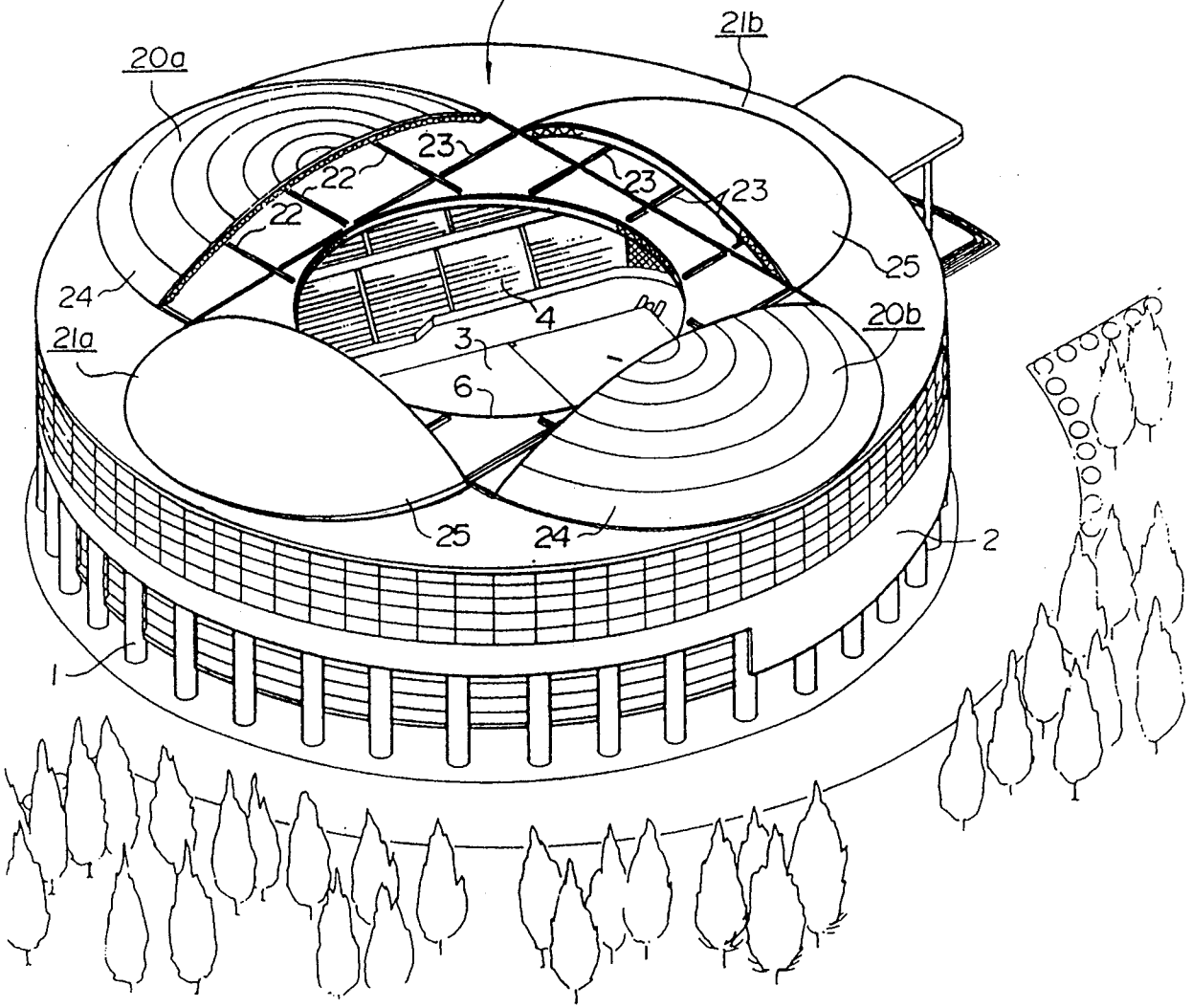
FIG. 14 is a perspective view showing the exterior of the facility of the second embodiment of the present invention.

The first embodiment of the present invention and examples of variations in form were explained above. Next, the second embodiment will be explained in reference to FIGS. 14 through 16. Additionally, where structural elements are identical to those described in the first embodiment, the same symbol will be applied, and a detailed explanation thereof will be omitted.

Figure 15:
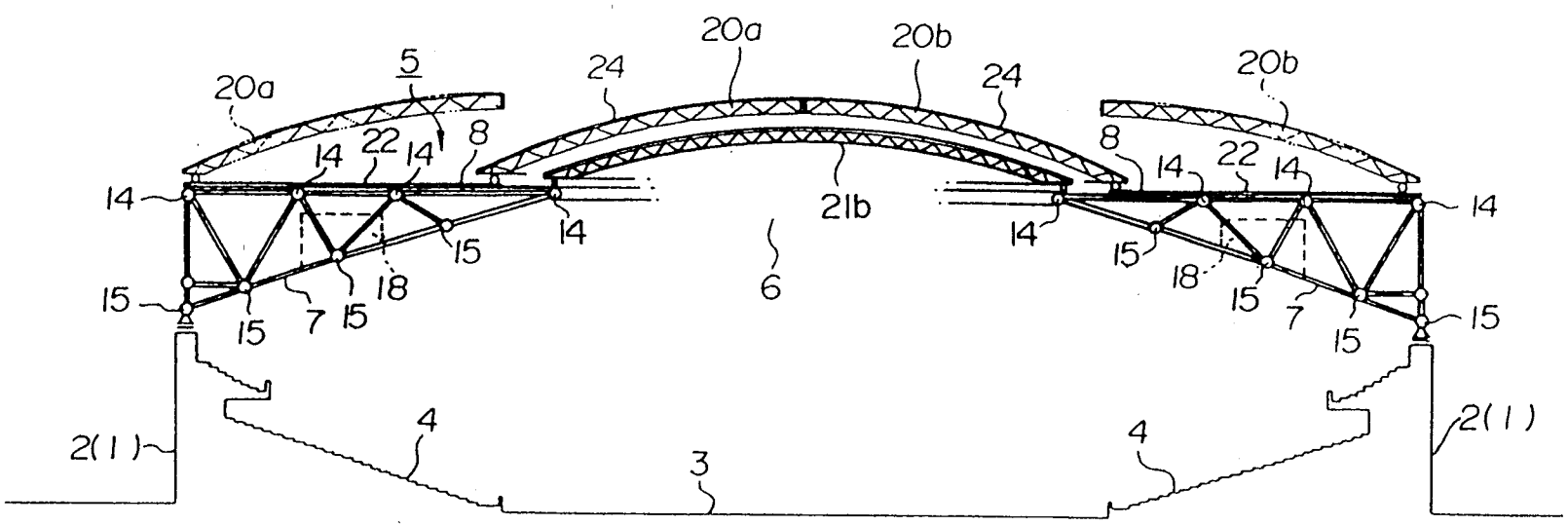
FIG. 15 is a vertical cross section of the same facility.
Figure 16:
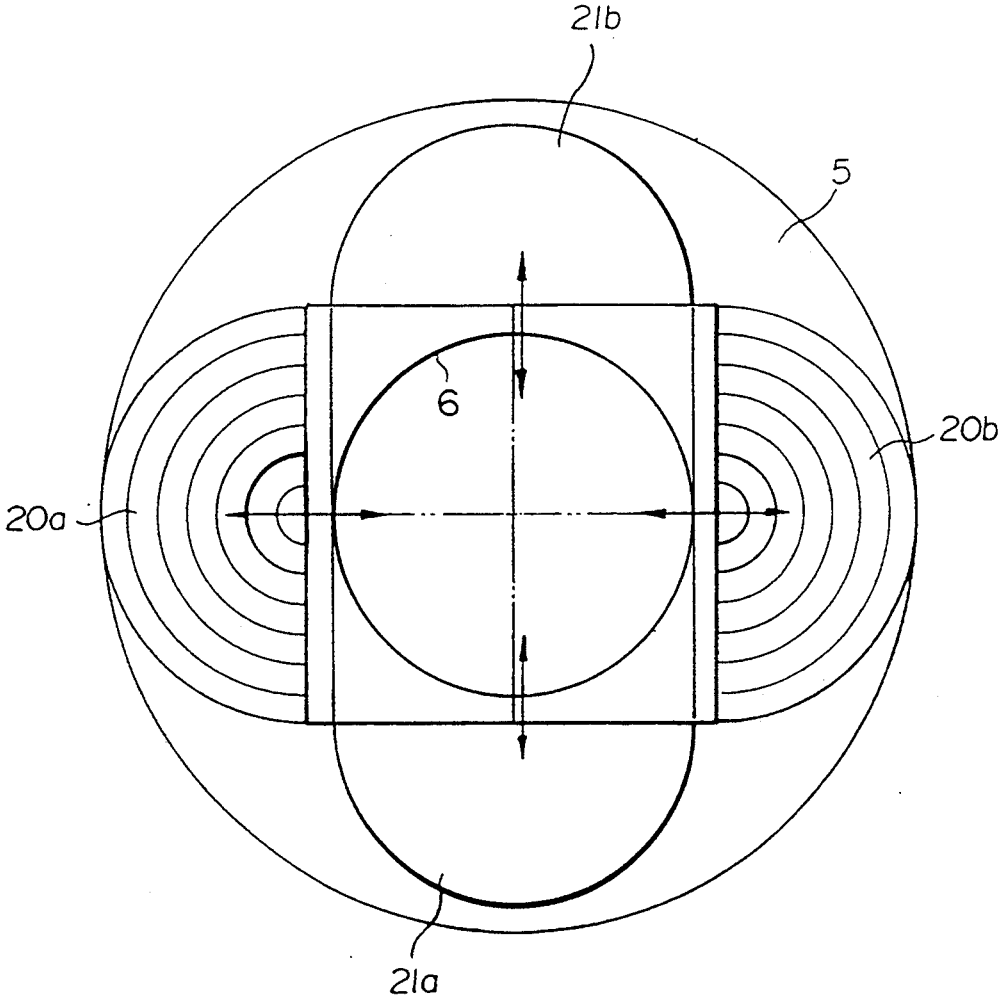
FIG. 16 is a plan view showing in outline the roof surface of the same facility.

In the second embodiment of the present invention, both the plane and the height measurements of one set of openable roof members 20*a* and 20*b* is, in comparison to the other set of openable roof members 21*a* and 21*b*, slightly smaller. In addition to being able to close aperture 6 with the smaller set of openable roof members 21*a* and 21*b*, it is also possible to cover over the smaller set of openable roof members 21*a* and 21*b* with the larger set of openable roof members 20*a* and 20*b*. In other words, as shown in FIG. 15, it is possible to shut aperture 6 in a bilayer fashion utilizing both pairs of openable roof members 20*a* and 20*b* and 21*a* and 21*b*.

Additionally, of the above two pairs of openable roof members 20*a* and 20*b* and 21*a* and 21*b*, roof material 24 of the larger set of openable roof members 20*a* and 20*b* is, in the same manner as the material of set roof 5, made from such opaque materials as metal plating or the like. However, for roof material 25 of the smaller set of openable roof members 21*a* and 21*b*, a plastic film, for example, fiber glass, etc., coated with a resin having as its principle component tetrafluoroethylene, etc., through which light may be transmitted, is utilized.

In the structure of the second embodiment, either one of the pairs of openable roof members is selected, and through the closing of aperture 6, the same effects as those of the above first embodiment may be obtained. In addition, however, the following effects are also obtained.

In other words, in the roof of the structure of the second embodiment, it is possible to increase the insulating effect of the roof surface by closure of aperture 6 in a bilayer fashion utilizing both of the two pairs of openable roof members 20*a* and 20*b* and 21*a* and 21*b*. At the same time, condensation and the like may be prevented. Furthermore, during snowfall, if aperture 6 is closed in a bilayer, with movable roof members 21*a* and 21*b* covered over by openable roof members 20*a* and 20*b*, because it is possible to prevent snow accumulation on the plastic film used as roof material 25 in openable roof members 21*a* and 21*b*, it is not necessary to anticipate a large snow load in relation to openable roof 21*a* and 21*b*. Accordingly, the application of this type of structure in cold and snowy regions is particularly appropriate. Furthermore, not only during snowfalls, but also when typhoons or the like are expected, provided that aperture 6 is closed in a bilayer with openable roof members 21*a* and 21*b* covered over by openable roof members 20*a* and 20*b*, it is possible to prevent the exposure of openable roof members 21*a* and 21*b* to strong winds, thereby assuring the safety of the structure.

Additionally, in the second embodiment as well, all variations and applications explained in the first embodiment are, of course, possible.

Next, the third embodiment will be explained with reference to FIGS. 17 through 21.

In the third embodiment, the upper surface of set roof 5 is inclined at an angle of 6° with respect to the horizontal plane, with the height from the ground 4 gradually decreasing along this line. In this manner, because of the incline of set roof 5, the external wall of the outfield is made lower, thereby lowering the skyline when the dome is opened. Additionally, in a structure provided with set roof 5, set roof 5 may also be provided parallel to the parallel plane. Furthermore, aperture 6 is formed in an almost circular shape, having as its center a point at the outfield stand which it separated from the center of set roof 5. A diameter has been provided extending from home base to the outfield stands of a dimension with which it is possible to uncover the area above ground 4.

In the upper surface of set roof 5, two pairs of openable roof members 20*a* and 20*b* and 21*a* and 21*b*, comprised respectively from half domes, are rotated using as fulcrums the peripheral tip of the the edges along which they mutually come into contact, aperture 6 thereby being opened or closed.

In other words, each of openable roof members 20*a* and 20*b* and 21*a* and 21*b* is formed from solid struts. Both the plane and height measurement of one pair of the openable roof members 20*a* and 20*b* is, in comparison to the other pair of openable roof members 21*a* and 21*b*, slightly smaller. As a result, it is possible to enclose openable roof members 21*a* and 21*b* at the internal side of openable roof members 20*a* and 20*b*.

Furthermore, a plurality of circular arc rails 22*a* having mutually different radii and having the peripheral tip (the tip of the side of the home base stand) of the horizontal edge along which openable roofs 20*a* and 20*b* mutually touch as center point 01, and a plurality of circular arc rails 22*b* having mutually different radii and having the peripheral tip of the horizontal edge along which openable roofs 20*a* and 20*b* mutually touch as center point 02, are provided at set intervals in the upper surface of set roof 5 (only a single rail 22*b* is shown in FIG. 1). These rails 22*a* and 22*b* are installed to be respectively symmetrical with respect to straight line Y which connects central section 03 of aperture 6 to the above center points 01 and 02, and so that the rail 22*a* having the largest radius connects the area above the outfield stand to the external peripheral edge of set roof 5, and so that other rails 22*a* and 22*b* extend from the edge of aperture 6 to the external peripheral edge of set roof 5.

On the other hand, at the lower surface of the external edges of openable roof members 20*a* and 20*b* and 21*a* and 21*b* respectively, wheels 23*a* and 23*b* which turn on rails 22*a* and 22*b* (wheel 23*b* only is shown in relation to openable roof members 21*a* and 21*b* respectively), have been provided at set intervals along the circumferential direction. By means of a hydraulically or electrically driven drive (not shown here), openable roof members 20*a* and 20*b* and 21*a* and 21*b* pivot, using the points above center points 01 and 02 as fulcrums, moving along rails 22*a* and 22*b* through the action of wheels 23*a* and 23*b*, and, as a result, opening or closing aperture 6. Furthermore, openable roof members 20*a* and 20*b* and 21*a* and 21*b* are formed having dimensions such that approximately 90% of the baseball field is uncovered when the roof is open, and so that the openable roof members 20*a* and 20*b* and 21*a* and 21*b* may be installed in a planer fashion within set roof 5.

Figure 17:
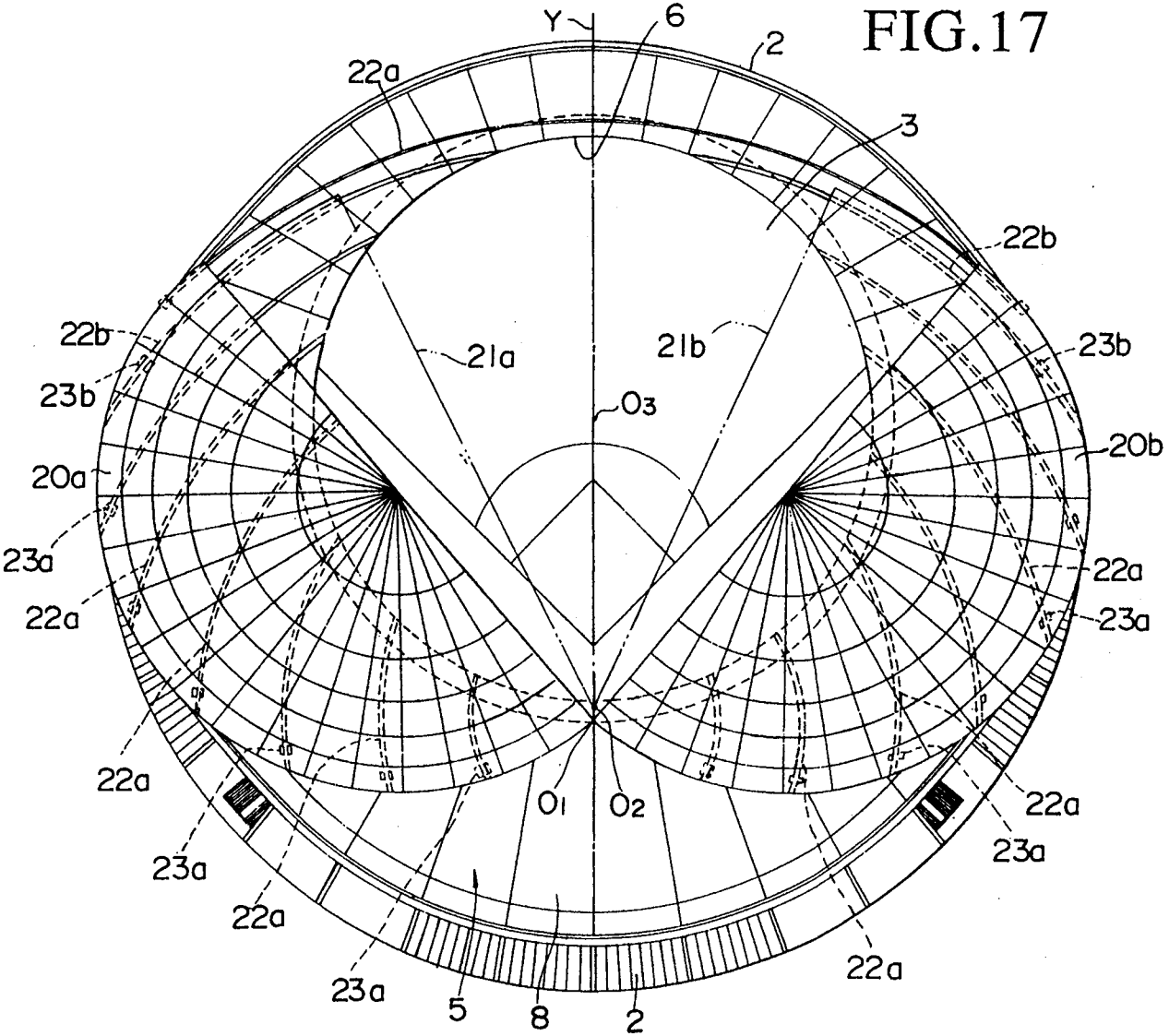
FIG. 17 is a plan view of the facility of the third embodiment of the present invention.
Figure 18:
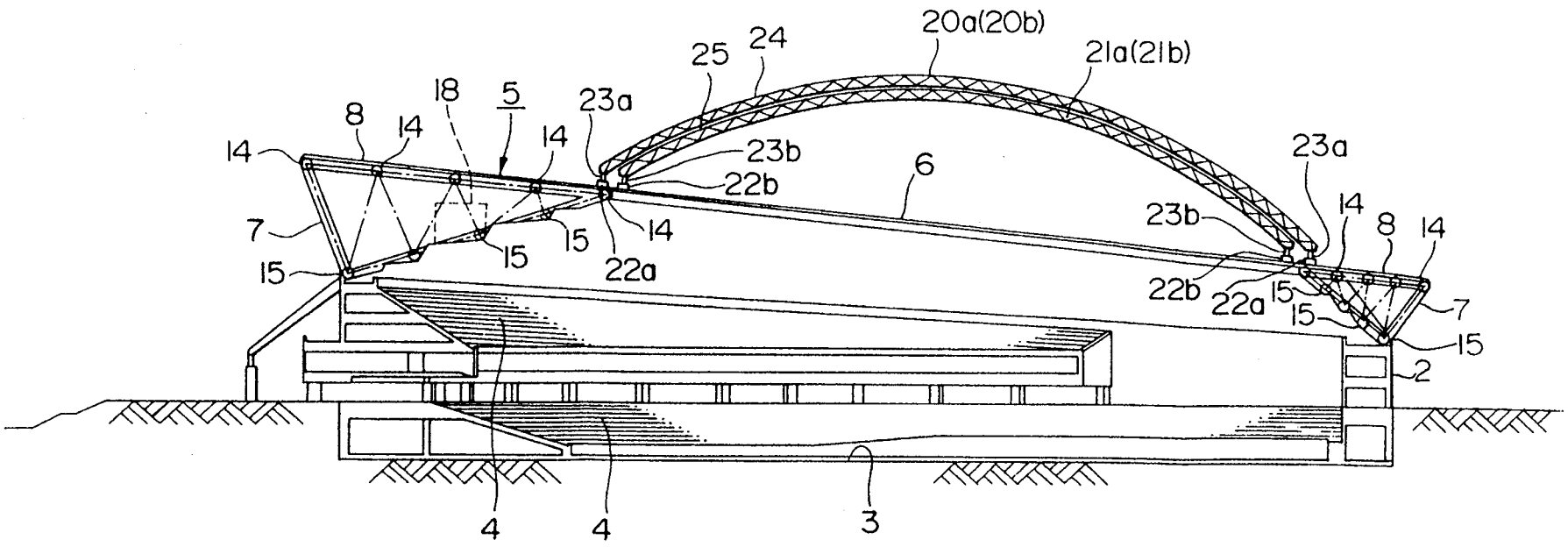
FIG. 18 is a vertical cross section of the same facility.
Figure 19:
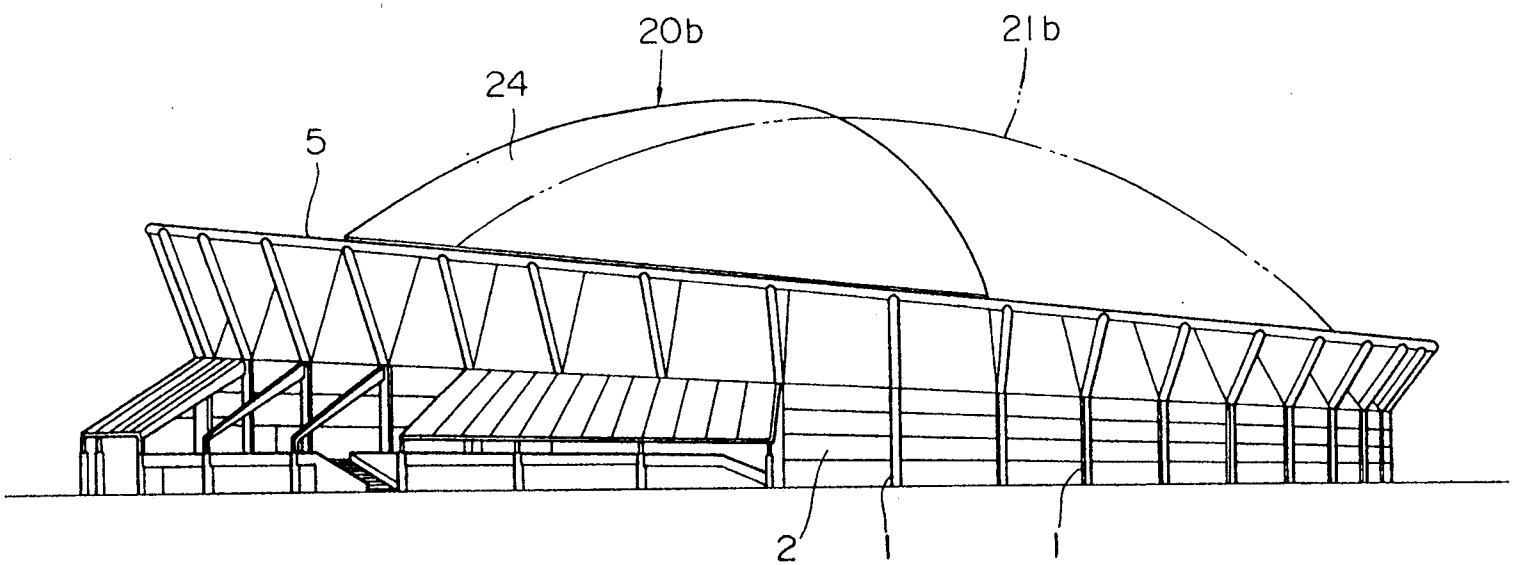
FIG. 19 is a side view of the same facility.
Figure 20:
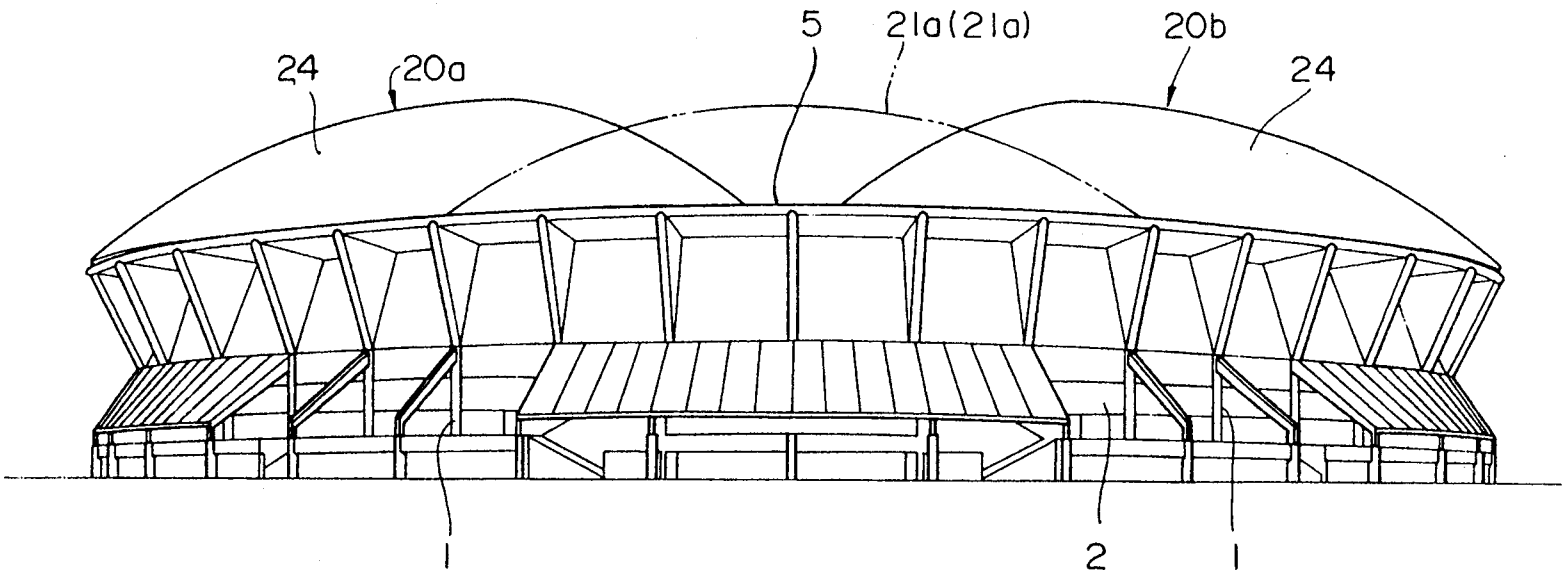
FIG. 20 is a front view of the same facility.
Figure 21:
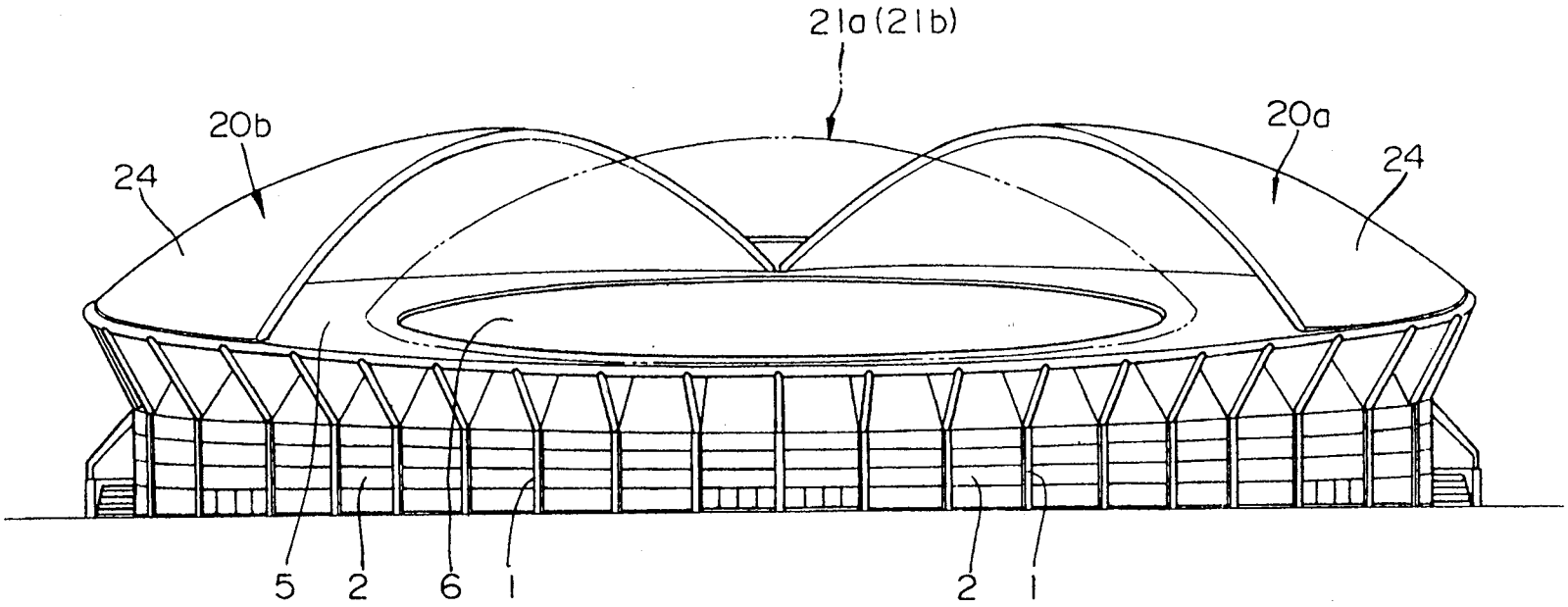
FIG. 21 is a rear view of the same facility.

As shown in FIG. 17, during normal operation, when a large portion of the above two pairs of openable roof members 20*a* and 20*b* and 21*a* and 21*b* has been positioned on the upper part of set roof 5, aperture 6 is open (uncovering approximately 90% of the ball field). However, it is also possible to close aperture 6 with either pair of the two pairs of openable roof members 20*a* and 20*b* and 21*a* and 21*b* as necessary. Furthermore, in addition to being able to shut aperture 6 with openable roof members 21*a* and 21*b*, it is also possible to cover over openable roof members 21*a* and 21*b* with openable roof members 20*a* and 20*b*. In other words, it is possible to close aperture 6 in a bilayer fashion by utilizing both pairs of openable roof members 20*a* and 20*b* and 21*a* and 21*b*.

Additionally, as was the case for the first and second embodiments, roof material 24 in one pair of openable roof members 20*a* and 20*b* of the two pairs of openable roof members 20*a* and 20*b* and 21*a* and 21*b*, in the same manner as the material of set roof 5, is made from such opaque material as metal plating, or the like. However, roof material 25 of the other pair of openable roof members 21*a* and 21*b* is made from a translucent film material, for example, fiber glass textile which has been coated with a resin having tetrafluoroethylene as its major component.

In the third embodiment, because set roof 5 is inclined so that the height from ground 4 gradually increases from the outfield stands to home base, it is possible to widen the space near home base in which the stands are installed, thereby satisfying the demand on the part of spectators for the ability to view a game from a closer position. Additionally, due to the inclination of set roof 5, sufficient light and circulating air may enter through opened aperture 6, producing an ample sense of spaciousness within the facility.

Furthermore, because circular aperture 6 is provided, having as its center a position (center section 03) which is separated from the center section of the upper surface of set roof 5, and because openable roof members 20*a* and 20*b* (21*a* and 21*b*), comprised of half domes, are placed on top of set roof 5, with aperture 6 being open or shut by the pivoting of the openable roof members, utilizing as a fulcrum (center point 01 and 02) the peripheral portions of the edges along which openable roof members 20*a* and 20*b* and 21*a* and 21*b* mutually touch, even if the area of the aperture is large, the space necessary when rotating openable roof members 20*a* and 20*b* and 21*a* and 21*b* and the planar housing space is sufficient, making it possible to house openable roof members 20*a* and 20*b* and 21*a* and 21*b* in a planar fashion in set roof 5. As a result, it is possible to limit the construction surface.

Figure 22:
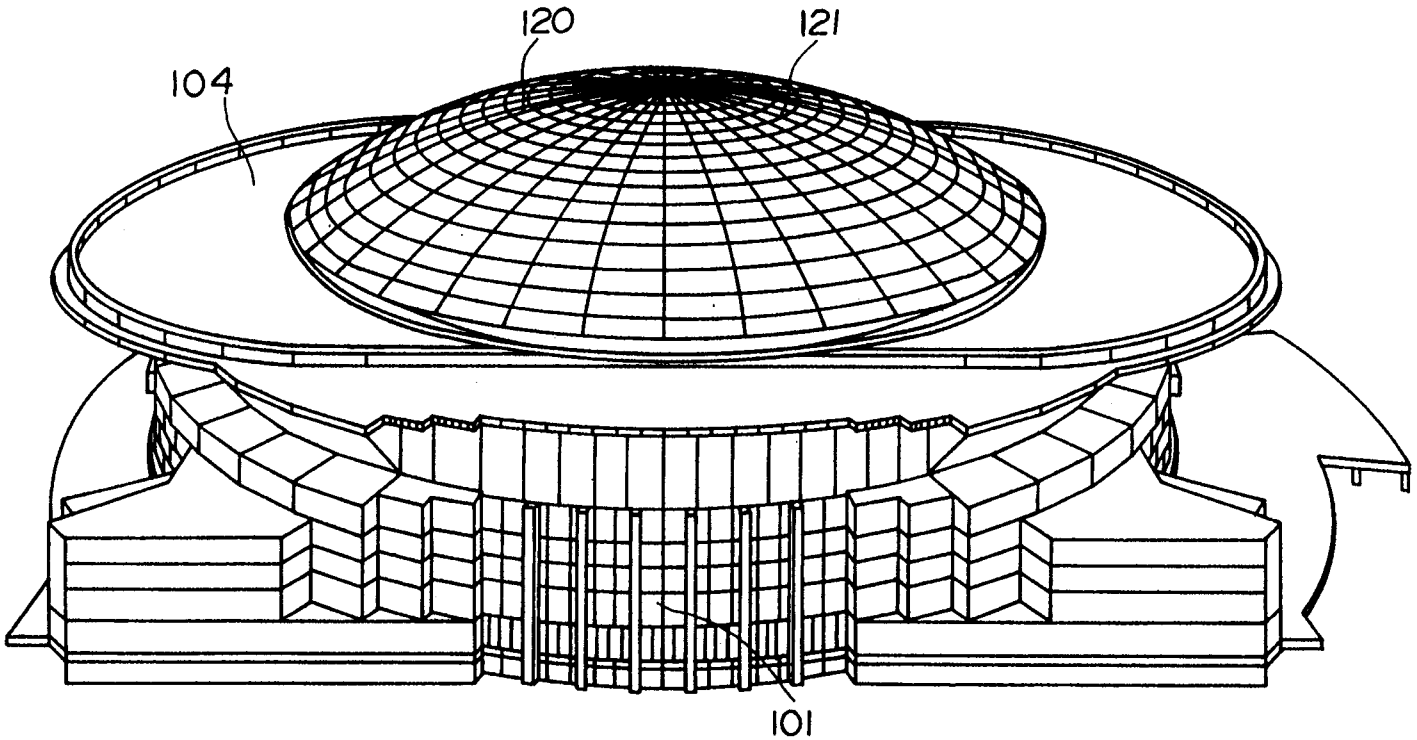
FIG. 22 is a perspective view showing an external view of the facility of the fourth embodiment of the present invention.
Figure 23:
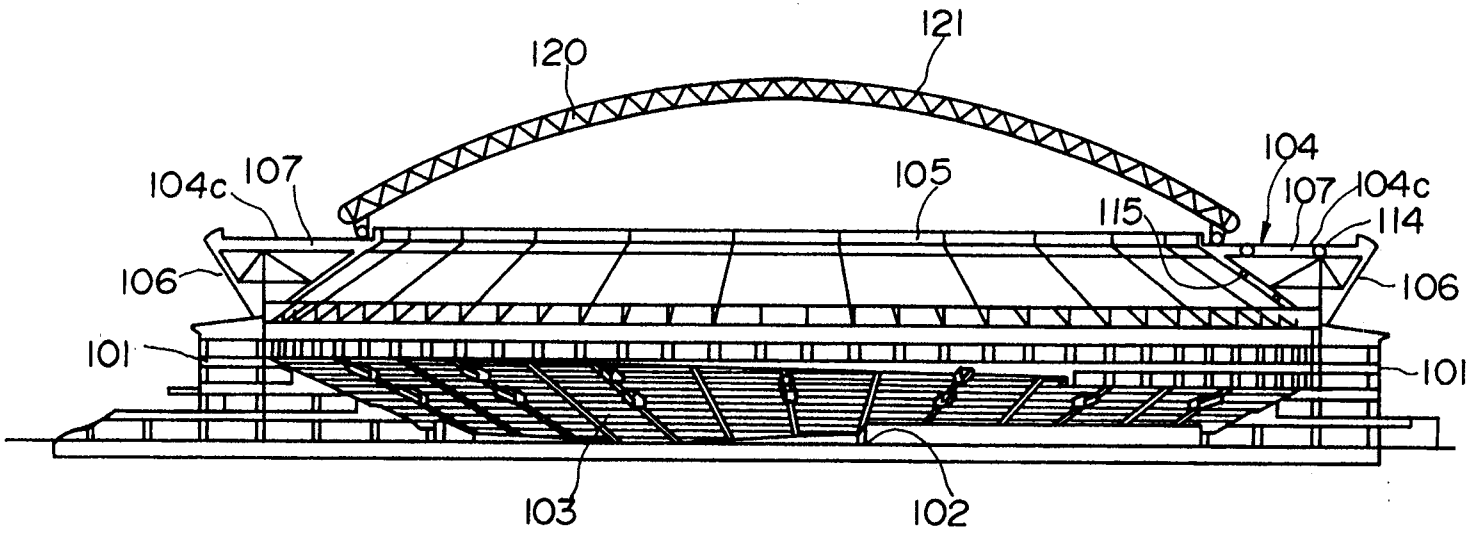
FIG. 23 is a vertical cross section of the same facility.
Figure 24:
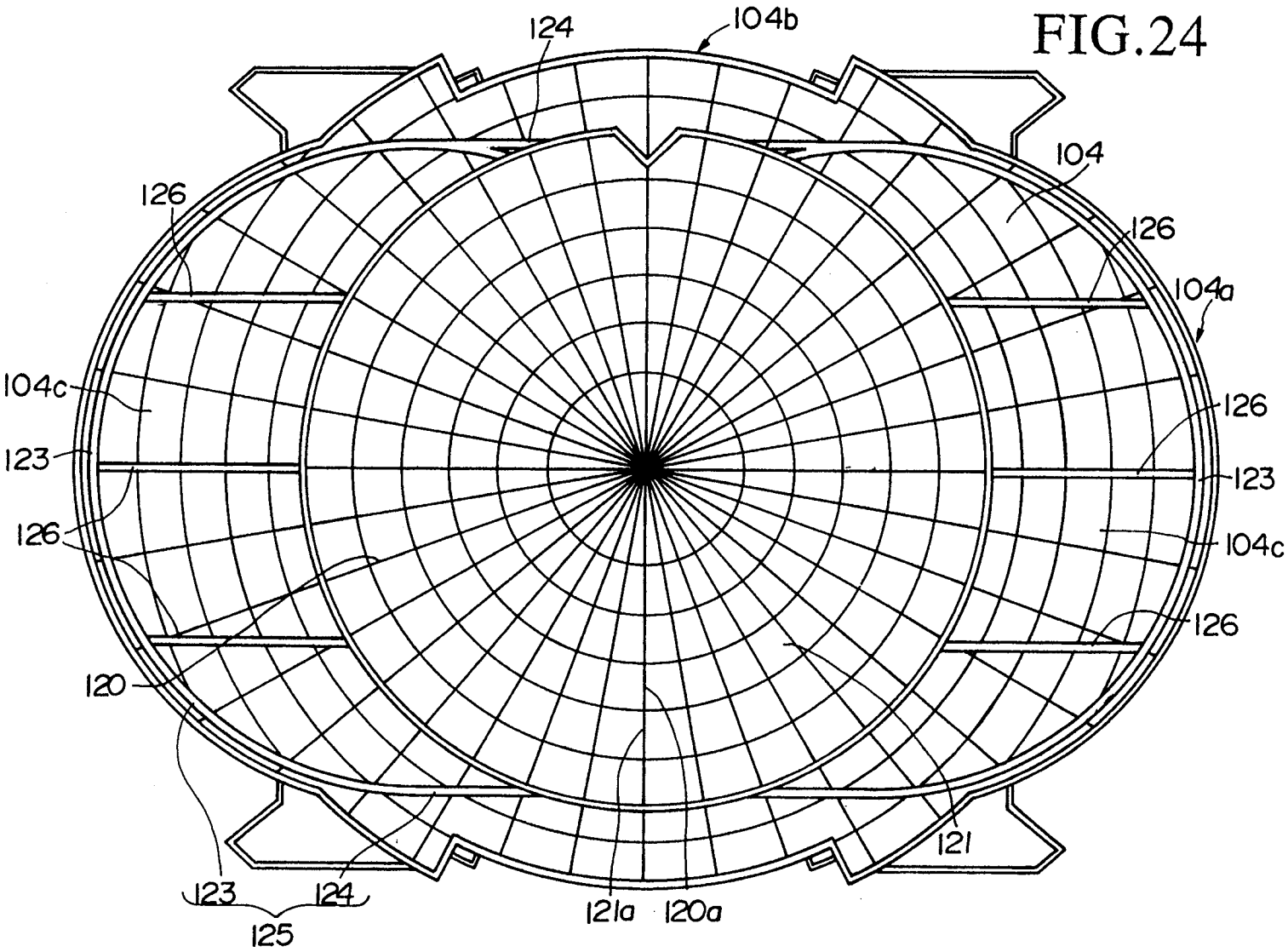
FIG. 24 is a plan view of the same facility with the aperture closed.
Figure 25:
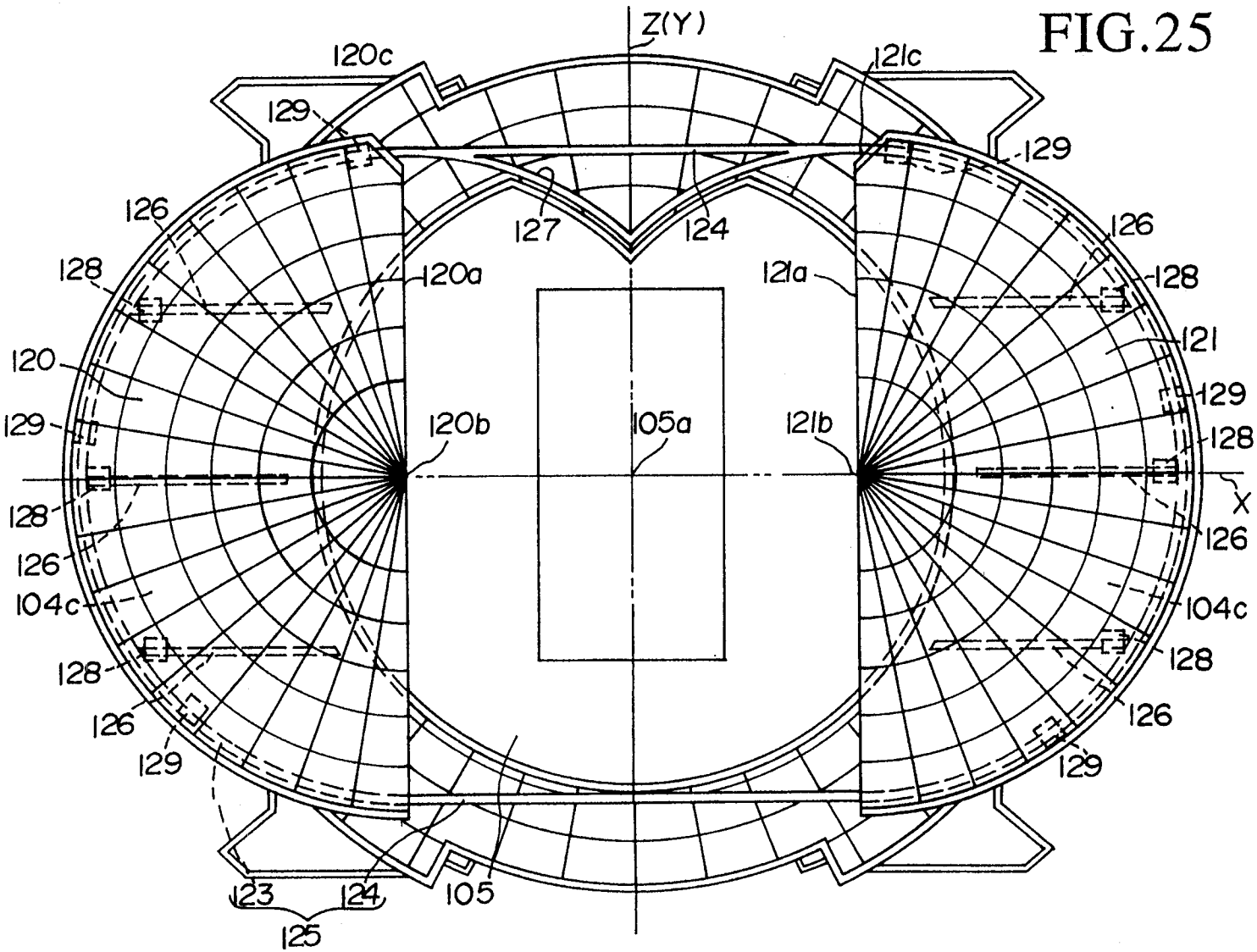
FIG. 25 is a plan view showing the opened aperture following the parallel movement of the openable roofs.
Figure 26:
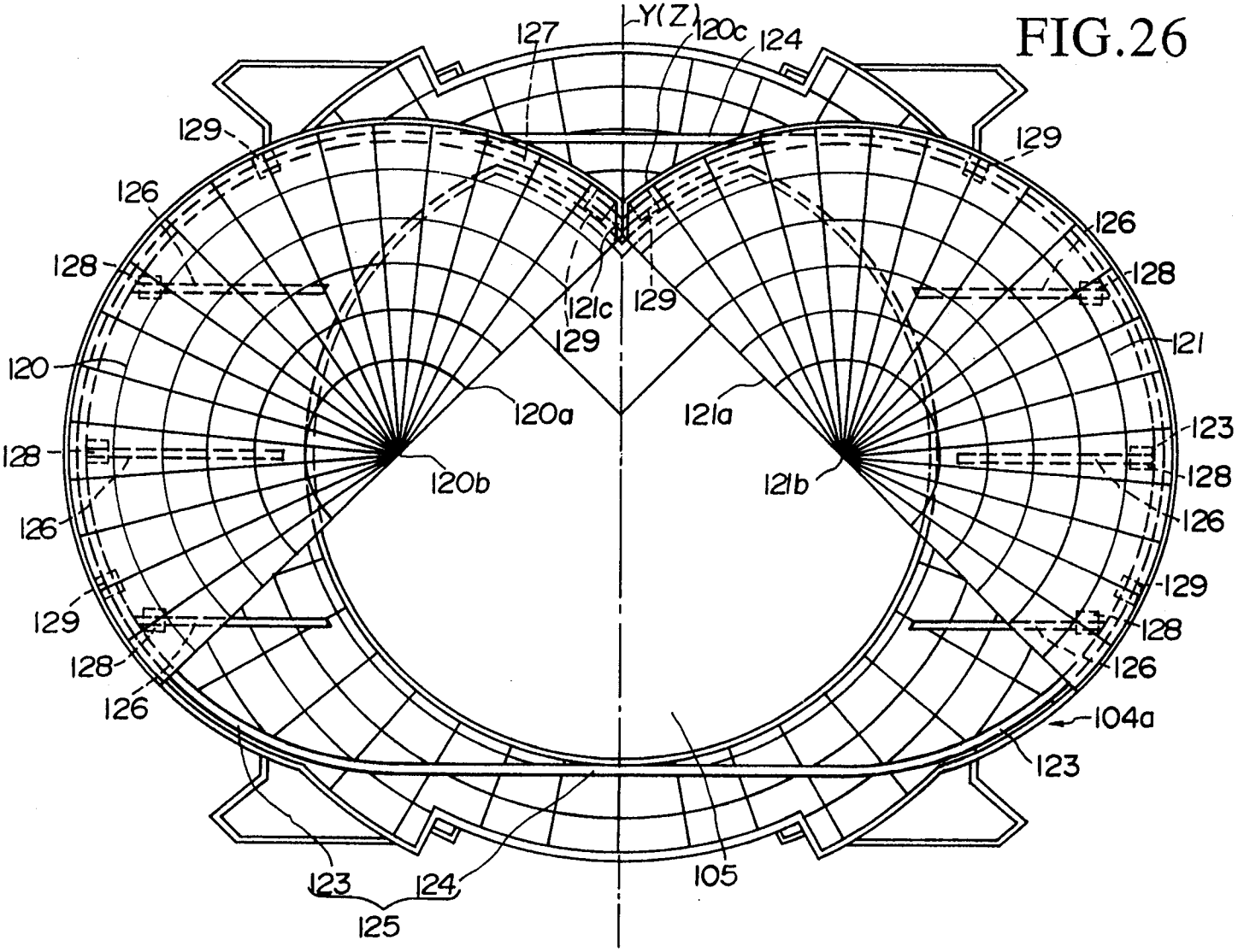
FIG. 26 is a plan view showing the opened aperture following rotational movement of the openable roof members.
Figure 27:
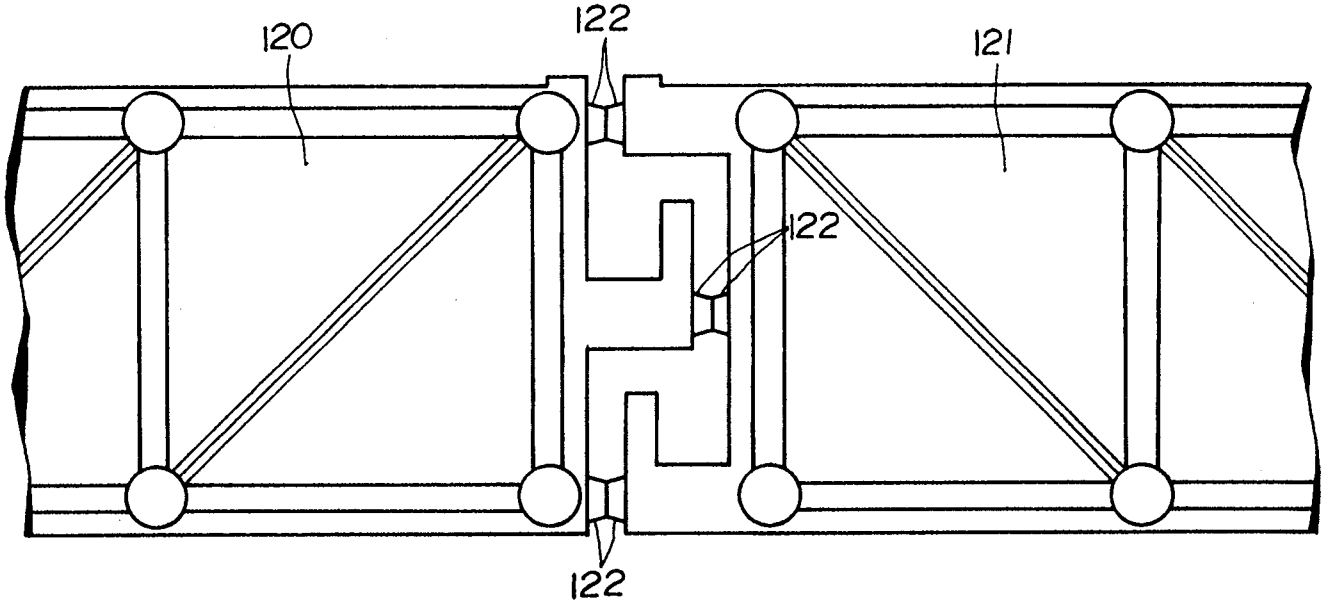
FIG. 27 is an enlarged view showing the containment of the edge portion of the openable roof members.

The fourth embodiment of the present invention will now be explained with reference to FIGS. 22 through 28. FIG. 22 is a perspective view of a stadium having a variety of purposes, and equipped with a roof of the structure of the fourth embodiment. FIG. 23 is a side cross sectional view. FIG. 24 is a plan view showing the aperture closed by the openable roof members. FIG. 25 and FIG. 26 are plan views showing the movement of the openable roof members. FIG. 27 is an enlarged view showing the installed section of the peripheral section of the openable roof members.

In these figures, 101 is the external wall constructed so as to form a round body. Ground 102 (arena) is within external wall 101, while at the same time stands 103, where the spectators are seated, has been provided around the periphery of ground 102.

Furthermore, 104 is a set roof having aperture 105 in a position above ground 102 and is provided so as to cover the entire circumference of the area above stand 103, and having, as seen from above, a bilayer external appearance created from the placing of oval shape 104*a* on elliptical shape 104*b* so that the center of oval shape 104*a* is directly above the center point of elliptical shape 104*b*. Upper surface 104*c* of set roof 104 is provided parallel or inclined to the horizontal plane. Furthermore, aperture 105 is constructed in a circular shape, the center portion of which has as its center the central portion of set roof 104, establishing a diameter of a dimension with which it is possible to uncover the area above ground 102.

Additionally, the above set roof 104 is formed from the attaching of roof material 107, comprised of such opaque material as metal plating, concrete slab, or the like, to the upper surface of solid strut 106 which is provided by the support of the external peripheral edge by external wall 101. As in the first through the third embodiments, a plurality of respective reinforcement rings have been provided.

In the upper surface of the above explained set roof 104, a pair of openable roof members 120 and 121 which open or close aperture 106, and which are respectively comprised from half domes, are provided. As shown in FIG. 24, this pair of openable roof members 120 and 121 close aperture 105 when edges 120*a* and 121*a* of openable roof members 120 and 121 are made to contact. Furthermore, as shown in FIG. 25, both of the openable roof members 120 and 121 separate and move in parallel so that a line of symmetry is formed along straight line F which passes through center point 105*a* of aperture 105. Additionally, as shown in FIG. 26, a device is provided for the reverse rotation of openable roofs 120 and 121, this rotation being centered about center sections 120*b* and 121*b* of edges 120*a* and 121*a* of openable roofs 120 and 121 so that the peripheral tips 120*c* and 121*c* of the edges 120*a* and 121*a* of openable roofs 120 and 121 come into contact.

In other words, each of openable roof members 120 and 121 is comprised from solid struts. When aperture 105 is closed by openable roofs 120 and 121 as is shown in FIG. 27, openable roof members 120 and 121 form a tight seal by means of the pushing together of a pair of rubber products 122 which are provided respectively at the edges of openable roofs 120 and 121. The vertical and parallel variation of openable roof members 120 and 121 is carried out smoothly, while maintaining a water tight and air tight surface.

Furthermore, rail 125, comprised from rounded section 123 and straight section 124, is provided in upper surface 104*c* of set roof 104, extending along the peripheral side of oval 104*a*. Moreover, a plurality of rails 126 are linearly installed at set intervals along the length X at the external side of oval 104*a*. Furthermore, as seen from above, triangle rail 127 is provided at a position diverging from round section 123 of oval rail 125, with an apex pointing inward along the short diameter Z (along the diameter of round section 104*b*) of oval shaped 104*a*.

On the respective lower surfaces of openable roofs 120 and 121, wheels 128, which respectively roll along straight line rail 126, are installed at set intervals. Furthermore, at the lower surface of the respective peripheral edges of openable roof members 120 and 121, wheel 129, which rolls along oval rail 125, is provided at set intervals. Additionally, wheels 128 and 129 which turn along straight rail 126, oval rail 125, and triangle rail 127 (the diverging rail) are comprised of a special drive wheel and caster (not shown). When the special drive wheel rolls, the caster moves, for example, in the upper direction, without rolling along a rail.

Wheel 129 rolls along straight rail 126 by means of an electric drive or oil drive, with openable roof members 120 and 121 moving by mutually separating in parallel displacement. Openable roof members 120 and 121, the parallel displacement of which has been terminated, have been provided with measurements such that they may be enclosed in parallel in the upper surface of the peripheral side of set roof 104.

When ground 102 is used for such competitive purposes as soccer or American football, through the rolling motion of wheel 128 along straight rail 126, mutually touching edges 120*a* and 121*a* separate in parallel, causing the parallel displacement of openable roof members 120 and 121. As a result, openable roofs 120 and 121, which have been displaced, are enclosed in a planer fashion in the upper section of peripheral side of set roof 104. As a result, as shown in FIG. 25, when seen from above, the rectangularly shaped ground 102 for soccer or American football is completely uncovered. The time required for the parallel displacement of openable roofs 120 and 121 is approximately 5 minutes.

Furthermore, when ground 102 is used as a baseball field, through the rolling motion of wheel 129 along round section 123 of oval rail 125 and then along diverging rail 127, which diverges from oval rail 125, openable roofs 120 and 121, which have been enclosed in the upper portion of the peripheral side of set roof 104, revolve; this rotational movement being centered about center portion 120*b* and 121*b* of mutually contacting edge sections 120*a*, 121*a*. Tips 120*c* and 121*c* of edge sections 120*a* and 121*a* come into contact through the rotational displacement of openable roofs 120 and 121, along diverging rail 127 and oval rail 125. As a result, as shown in FIG. 26, when seen from above, fan shaped ground 102, which is used as a baseball field is uncovered, aperture 105 being approximately 90% open. The required time for the rotational transfer of openable roof members 120 and 121 is approximately 5 minutes.

The roof material of one pair of openable roof members 120 and 121 may be made from the same material as is utilized in set roof 104, namely, an opaque material such as metal plating or the like, or it may be made from translucent material, such as glass fiber coated with a resin which has as its main component tetrafluoroethylene resin.

In a facility provided with a roof having the structure of the forth embodiment, in times of inclement weather, or as is otherwise necessary, aperture 105 may be closed by the pair of openable roof members 120 and 121. As a result, usage of the facility may be rendered free of restrictions imposed by weather conditions. Furthermore, on fair days, when the ground is used for soccer or American football competitions, the parallel displacement of openable roof members 120 and 121 may be completed in no more than 5 minutes, and as seen from above, the entire rectangular field may be uncovered. Furthermore, when the ground is used as a baseball field, approximately only 5 minutes are required to rotate openable roof members 120 and 121 from the position to which they have been moved in parallel. Combining this with the time necessary for parallel displacement, a total of only 10 minutes are required for complete movement of the openable roof members, making it possible to uncover the fan shaped ground.

In a facility provided with a roof having a structure of this type, because two modes of movement exist for moving the pairs of openable roof members 120 and 121 along the upper surface 104*c* of set roof 104, that is, parallel movement and rotational movement, and thereby opening or shutting aperture 105, it is possible to carry out the opening and shutting of openable roof members 120 and 121 in response to the type of event being held within a short period of time without requiring a complicated drive mechanism as compared to openable roof structures of the past art. At the same time, sufficient circulating air and light may enter through aperture 105, and a feeling of spaciousness within the facility is produced.

Furthermore, even if the aperture area is made large, because it is possible to contain openable roofs in parallel within set roof 104, and because the necessary space when moving openable roof 120 and 121 and the parallel storage space when opening openable roof is sufficiently provided, it is possible to limit the construction surface to a considerably small size.

Figure 28:
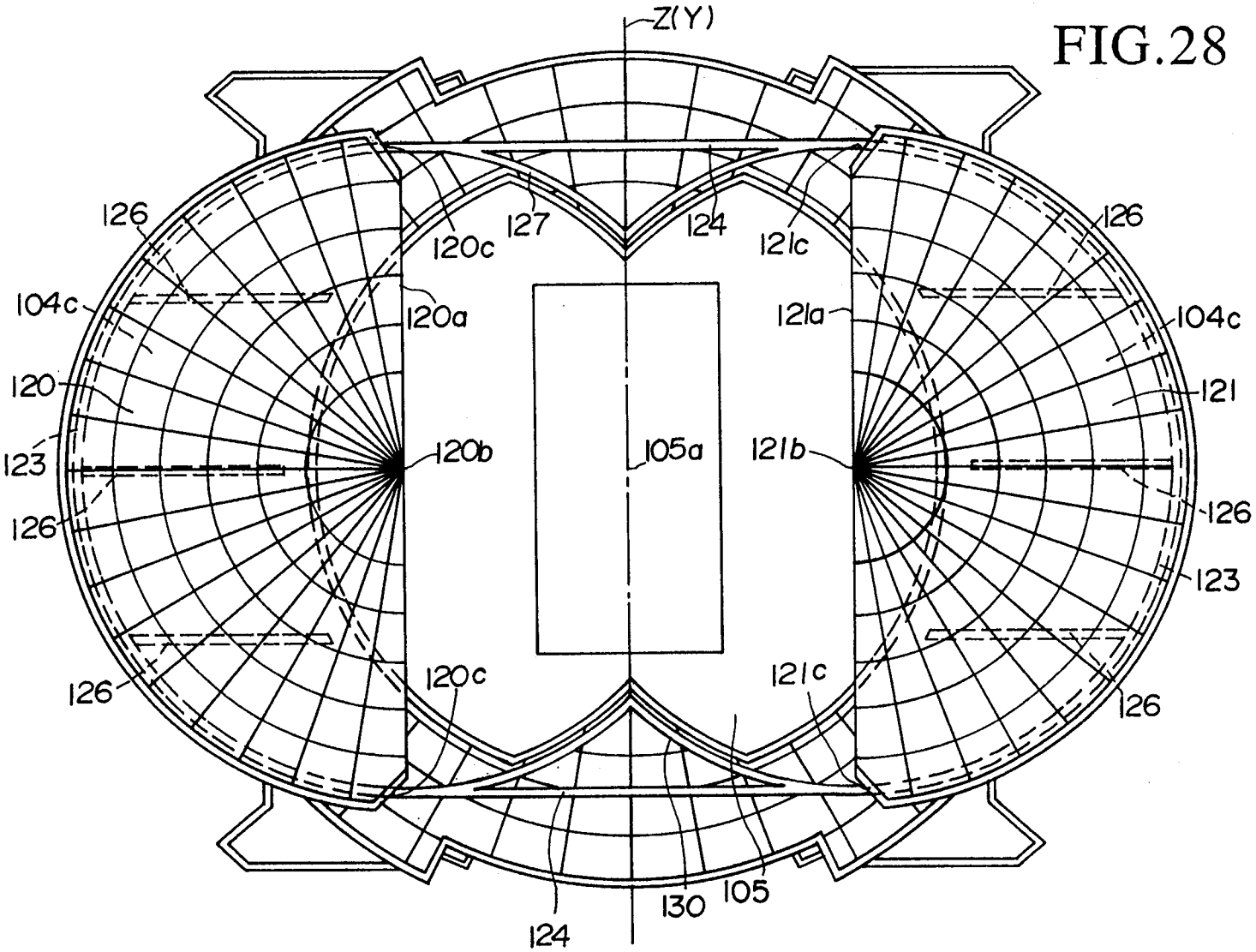
FIG. 28 is a plan view showing a variation in the structure of the fourth embodiment.

Furthermore, variations in application of the fourth embodiment are also possible. For example, in the above embodiment, although openable roof members 120 and 121 are structured so that single direction rotational displacement of openable roof members 120 and 121 is performed; it is also possible, as is shown in FIG. 28, to provide diverging rail 130 so that bidirectional rotational displacement is possible. Furthermore, in response to the type of event being held, openable roof members 120 and 121 may be half opened and then gradually further opened or closed to achieve a desired effect. In so doing, when admiring a starry night or the like, for example, it is possible to provide the spectators with a superior sensory experience. Additionally, the shape of aperture 105 provided in set roof 104 is not limited to a round shape, but may also be elliptical, or multisided. In this case, the shape of openable roofs may be not only the circular shape seen from above, but also any other corresponding variation appropriate to the shape of the aperture.

What is claimed is:

1. An openable roof structure comprising:

a ring-shaped fixed roof having an aperture; and a first pair and a second pair of movable roof sections;

wherein each movable roof section is in the form of half a dome, the first pair and the second pair of movable roof sections are disposed on the ring-shaped fixed roof, the movable roof sections disposed so that either pair of movable roof sections are movable into a position so as to close the aperture, and the first pair of the movable roof sections being larger laterally and in height than the second pair of movable roof sections and disposed so as to allow the first pair of movable roof sections to cover the second pair of movable roof sections when the aperture is closed.

2. An openable roof structure according to claim 1, wherein one pair of movable roof sections is composed of a translucent material and the other pair of movable roof sections is composed of an opaque material.

3. An openable roof structure according to claim 2, wherein the ring-shaped fixed roof is disposed horizontally.

4. An openable roof structure according to claim 2, wherein the center of the ring-shaped fixed roof and the center of the aperture in the ring-shaped fixed roof do not coincide.

5. An openable roof structure according to claim 2, wherein the movable roof sections pivot at the lateral ends thereof.

6. A openable roof structure according to one of claim 1, wherein at least one pair of movable roof structures is sound-regulating.

7. An openable roof structure according to claim 6, wherein the movable roof sections first move horizontally apart, then rotate in opposite directions so as to bring a lateral end of each movable roof section into proximity with a lateral end of the other member of the pair of movable roof sections.

8. An openable roof structure according to claim 6, wherein the ring-shaped fixed roof has a generally flat upper surface.

9. An openable roof structure according to claim 6, wherein the ring-shaped fixed roof comprises a plurality of struts and a plurality of circumferential reinforcement rings.

10. An openable roof structure comprising:

a ring shaped fixed roof having an aperture; and two pairs of movable roof sections;

wherein each movable roof section is in the form of half a dome, said two pairs of movable roof sections are disposed on the ring-shaped fixed roof, and the movable roof sections are disposed so that either pair of movable roof sections are movable into a position so as to close the aperture.

11. An openable roof structure according to claim 10, wherein said fixed roof has a flat upper surface and a depth decreasing radially outwards, and said fixed roof comprises a plurality of struts and plurality of circumferential reinforcement rings.

12. An openable roof structure according to claim 11, wherein one pair of said movable roof sections is composed of a translucent material and the other pair of said movable roof sections is composed of an opaque material.

13. An openable roof structure according to claim 12, wherein at least one pair of said movable roof sections is sound regulating.

14. An openable roof structure according to claim 13, wherein at least two pairs of guide rails are disposed on said fixed roof in radial directions perpendicular to each other so that each of the movable roof sections are movable along said guide rails to open and close said opening of said fixed roof.

15. An openable roof structure according to claim 13, wherein said movable roof sections are rotatably attached to said fixed roof so that the movable roof sections are movable about said fixation and each pair of said movable roof sections opens and closes said opening.

* * * * *